US005335724A

United States Patent [19]

Venditto et al.

[11] Patent Number: 5,335,724

[45] Date of Patent: Aug. 9, 1994

[54] DIRECTIONALLY ORIENTED SLOTTING METHOD

[75] Inventors: James J. Venditto, Sugar Land, Tex.; Kenneth D. Caskey, Duncan, Okla.

[73] Assignee: Halliburton Company, Duncan, Okla.

[21] Appl. No.: 98,469

[22] Filed: Jul. 28, 1993

[51] Int. Cl.[5] ..... E21B 43/114; E21B 43/26; E21B 47/02

[52] U.S. Cl. ..... 166/298; 166/308; 166/250; 73/153

[58] Field of Search ..... 166/308, 250, 254, 298; 73/153; 175/4.51

[56] References Cited

U.S. PATENT DOCUMENTS

| | | | |
|---|---|---|---|
| 2,414,997 | 1/1947 | Atkins | 285/97.3 |
| 4,047,569 | 9/1977 | Tagirov et al. | 166/298 X |
| 4,134,453 | 1/1979 | Love et al. | 166/298 |
| 4,523,649 | 6/1985 | Scout | 175/4.51 |
| 4,529,036 | 7/1985 | Daneshy et al. | 166/254 |
| 4,542,648 | 9/1985 | Vinegar et al. | 73/153 |
| 4,637,478 | 1/1987 | George | 175/4.51 |
| 4,673,890 | 6/1987 | Copland et al. | 33/178 F |
| 4,830,120 | 5/1989 | Stout | 175/4.51 |
| 4,949,788 | 8/1990 | Szarka et al. | 166/285 |
| 4,979,561 | 12/1990 | Szarka | 166/240 |
| 4,991,654 | 12/1991 | Brandell et al. | 166/232 |
| 5,249,628 | 10/1993 | Surjaatmadja | 166/308 |

OTHER PUBLICATIONS

Gadeken, L. L., Ginzel, W. J., Sharbak, D. E., Shorck, K. A., and Sitka, M. A., "The Determination of Fracture Orientation Using a Directional Gamma Ray Tool," presented at the 1991 Society of Professional Well Log Analysts Annual Symposium in Midland, Tex., Jun. 1991.

Vinegar, H. J., "X-Ray CT and NMR Imaging of Rocks," Paper No. SPE 15277, Society of Petroleum Engineers, publication date unknown.

Bergosh, J. L., Marks, T. R., and Mitkus, A. F., "New Core Analysis Techniques for Naturally Fractured Reservoirs," Paper No. SPE 13653 presented at the SPE 1985 California Regional Meeting in Bakersfield, Calif., Mar. 27-29, 1985.

Honarpour, M. M., Cromwell, V., Hatton, D., and Satchwell, R., "Reservoir Rock Descriptions Using Computer Tomography (CT)," Paper No. SPE 14272 presented at the 60th Annual Technical Conference and Exhibition of the Society of Petroleum Engineers in Las Vegas, Nev., Sep. 22-25, 1985.

Hunt, P. K. and Engler, P., "Computed Tomography as a Core Analysis Tool: Applications and Artifact Reduction Techniques," Paper No. SPE 16952 presented at the 62nd Annual Technical Conference and Exhibition of the Society of Petroleum Engineers in Dallas, Tex., publication date unknown.

Gilliland, R. E. and Coles, M. E., "Use of CT Scanning in the Investigation of Damage to Unconsolidated Cores," Paper No. SPE 19408 presented at the SPE Formation Damage Control Symposium in Lafayette, La., Feb. 22-23, 1990.

Suzuki, F., "X-Ray Computed Tomography for Carbonate Acidizing Studies," Paper No. CIM/SPE 90-45 presented at the International Technical Meeting jointed hosted by the Petroleum Society of CIM and the (List continued on next page.)

*Primary Examiner*—Stephen J. Novosad

*Attorney, Agent, or Firm*—Dennis Brown; Robert A. Kent

[57] ABSTRACT

A method of fracturing a subterranean formation having a well bore extending thereinto. The method comprises the steps of: (a) placing a jetting tool in the well bore such that the jetting tool is positioned within the subterranean formation, the jetting tool including a jetting nozzle; (b) orienting, by rotating the jetting tool about a longitudinal axis, the jetting tool such that the directional orientation of the jetting nozzle substantially corresponds to a predetermined fracturing direction; and (c) cutting a slot in the subterranean formation (and/or casing) by substantially maintaining the jetting nozzle orientation established in step (b) while both (1) spraying a jetting fluid out of the first jetting nozzle and (2) moving the jetting tool longitudinally within the well bore along the longitudinal axis.

20 Claims, 15 Drawing Sheets

OTHER PUBLICATIONS

Society of Petroleum Engineers in Calgary, Canada, Jun. 10–13, 1990.

"With HLS Technology, CAST Light on the Hole Picture," Halliburton Logging Services, Inc., 1989.

Seiler, D., Edmiston, C., Torres, D., and Goetz, J., "Field Performance of a New Borehole Televiewer Tool and Associated Image Processing Techniques," presented at the SPWLA Symposium in Lafayette, La., Jun. 1990.

Goetz, J. F., Seiler, D. D., and Edmiston, C. S., "Geological and Borehole Features Described by the Circumferential Acoustic Scanning Tool," Halliburton Logging Services, Inc., Publication date unknown.

Torres, D., Strickland, R., and Gianzero, M., "A New Approach to Determining Dip and Strike Using Borehole Images," Halliburton Logging Services, Inc., publication date unknown.

An advertisement by Halliburton Logging Services, Inc., for "TELECAST," publication date unknown.

An article entitled "CAST—The Circumferential Acoustic Scanning Tool," publication date unknown.

Aadnoy, B. S., "Modeling of the Stability of Highly Inclined Boreholes in Anisotropic Rock Formations," Paper No. SPE 16526 presented at the 1987 SPE Offshore Europe Conference in Aberdeen, Sep. 8–11, 1987.

Teufel, L. W., "Strain Relaxation Method for Predicting Hydraulic Fracture Azimuth from Oriented Core," Paper No. SPE/DOE 9836 presented at the 1981 SPE/DOE Low Permeability Symposium in Denver, Colo., May 27–29, 1981.

Teufel, L. W., "Prediction of Hydraulic Fracture Azimuth from Anelastic Strain Recovery Measurements of Oriented Core," *Issues in Rock Mechanics,* Chapter 25, published by the Society of Mining Engineers of the American Institute of Mining, Metallurgical and Petroleum Engineers, Inc., New York, N.Y., 1982.

Blanton, T. L., "The Relation Between Recovery Deformation and In-Situ Stress Magnitudes," Paper No. SPE/DOE 11624 presented at the 1983 SPE/DOE Symposium on Low Permeability in Denver, Colo., Mar. 14–16, 1983.

El Rabaa, A. W. M. and Meadows, D. L., "Laboratory and Field Applications of the Strain Relaxation Method," Paper No. SPE 15072 presented at the 56th California Regional Meeting of the Society of Petroleum Engineers in Oakland, Calif., Apr. 2–4, 1986.

A brochure entitled "Full Wave Sonic Log," Halliburton Logging Services, Inc., publication date unknown.

Fig. 1a
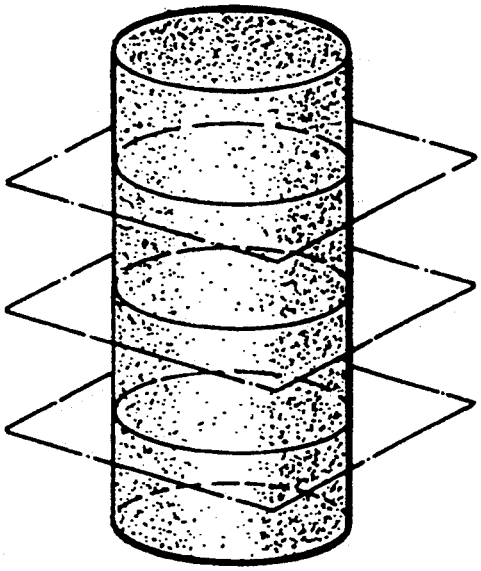
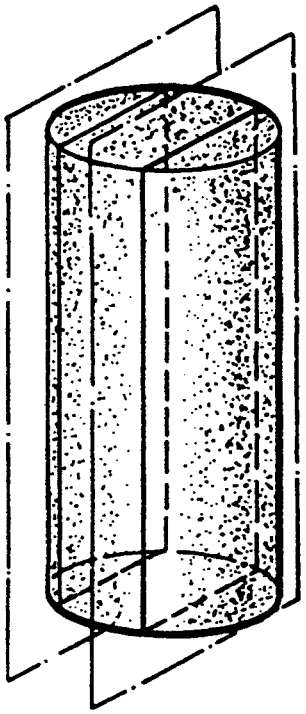
Fig. 1b
Fig. 2
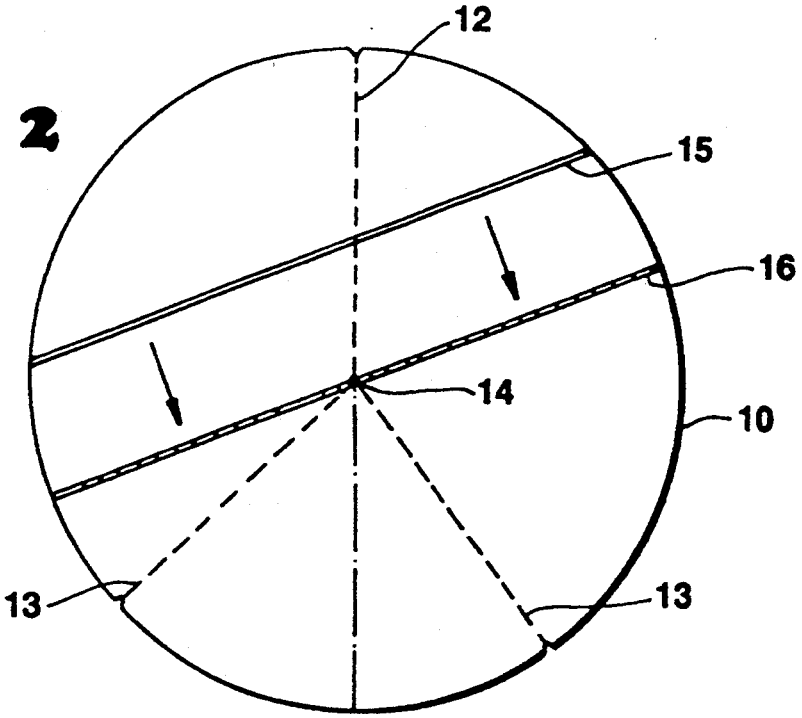

DIRECTIONALLY ORIENTED SLOTTING METHOD

FIELD OF THE INVENTION

The present invention relates to methods of fracturing subterranean formations. More particularly, but not by way of limitation, the present invention relates to methods of forming slots in casings and/or subterranean formations wherein the directional orientation of each slot corresponds to a preselected fracturing direction.

BACKGROUND OF THE INVENTION

In many instances, after a well is drilled to a desired depth, fractures must be induced in the surrounding formation in order to produce commercially significant quantities of hydrocarbons from the well. Certain prior art techniques of fracturing a well have involved the use of slotting tools to form slots in the formation at multiple locations for a given length of the well. Such slots could be made in either a random or organized pattern.

Thereafter, through techniques commonly employed in the industry, fractures in the formation would be induced by pumping a fracturing fluid, containing proppants, under high pressure, into the well bore and through certain of the slots until a fracture was initiated. Fracturing operations were then continued until the fractures were propagated a sufficient distance into the formation surrounding the well bore.

It is well known that after initiation of a fracture, a fracture will propagate away from the well bore in a radial direction that is perpendicular the minimum principal stress existing in the surrounding formation, i.e., the direction of propagation of the fractures is controlled by the state of stress existing in the surrounding formation. Nevertheless, heretofore, there has been no attempt in the art to align the slots produced by the slotting tools with the direction of fracture propagation, i.e., perpendicular to the minimum principal horizontal stress existing within the formation.

Certain problems encountered in fracturing operations are believed to have been due to the failure of prior art methods and techniques to align the slots with the direction of fracture propagation within a formation. In particular, nonalignment of the slots resulted in the use of excessive pressures to fracture the well, and resulted in the development of a tortuous flow path for the fracturing fluid as it flowed from the initial fracture formed in a nonaligned slot to the main fracture. The tortuous path developed because a fracture that was initiated at a non-aligned slot would curve as it propagated through the formation to align itself with the direction of propagation of the main fracture. This tortuous path caused excessive pressure drop as the fracturing fluid was pumped therethrough, and generally inhibited the timely and efficient completion of a well such that maximum production could be achieved therefrom.

The present invention solves all of the aforementioned problems by insuring alignment of the slots with the direction of fracture propagation within a field. By employing the method disclosed and claimed herein, lower fracture initiation pressures may be obtained, and other problems associated with near well bore tortuosity may be overcome.

SUMMARY OF THE INVENTION

The present invention is directed to a method for optimizing hydraulic fracturing operations by aligning well bore slots with the direction of fracture propagation, i.e., perpendicular to the minimum principal horizontal stress, existing within a formation. The present method can be used in both vertical and deviated wells (i.e., horizontal wells or wells drilled at an angle relative to a vertical well) and can be used to cut slots in both cased and uncased well bore sections. Through use of the present invention, many problems heretofore encountered in fracturing operations are avoided. For example, by forming, in accordance with the present invention, properly aligned slots through a well casing and/or into the formation being fractured, the fracture initiation process is facilitated whereby fractures are initiated at lower pressures and the problems associated with near well bore tortuosity are avoided.

In one embodiment, the present invention provides a method of fracturing a subterranean formation having a well bore extending thereinto. The method comprises the steps of: (a) placing a jetting tool in the well bore such that the jetting tool is positioned within the subterranean formation, said jetting tool including a jetting nozzle; (b) orienting, by rotating the jetting tool about a longitudinal axis, the jetting tool such that the directional orientation of the jetting nozzle substantially corresponds to a selected fracturing direction; and (c) cutting a slot in the subterranean formation by substantially maintaining the jetting nozzle orientation established in step (b) while both (1) spraying a jetting fluid out of the jetting nozzle and (2) moving the jetting tool longitudinally within the well bore along the longitudinal axis.

In a second embodiment, the present invention provides a method of fracturing a subterranean formation having a well bore extending thereinto with a casing positioned in the well bore. The inventive method comprises the steps of: (a) placing a jetting tool in the casing such that the jetting tool is positioned within the subterranean formation, said jetting tool including a jetting nozzle; (b) orienting, by rotating the jetting tool about a longitudinal axis, the jetting tool such that the directional orientation of the jetting nozzle substantially corresponds to a selected fracturing direction; and (c) cutting a slot in the casing by substantially maintaining the jetting nozzle orientation established in step (b) while (1) spraying a jetting fluid out of the jetting nozzle and (2) moving the jetting tool longitudinally within the casing along the longitudinal axis.

Through the use of the method disclosed and claimed herein, efficient fracturing of a formation may be achieved, thereby allowing a greater degree of hydrocarbon recovery from the formation. Additional benefits from using the method disclosed and claimed herein will be apparent to those of ordinary skill in the art upon reference to the accompany drawings and upon reading the following Description of the Preferred Embodiments.

BRIEF DESCRIPTION OF THE DRAWINGS

FIG. 1A is a cross-sectional view of a horizontal CT scan image through a cylinder core;

FIG. 1B is a cross-sectional view of axial and longitudinal CT scan images through a cylindrical core;

FIG. 2 is a schematic for obtaining fracture orientation from CT slice data in reference to orientation scribes;

DETAILED DESCRIPTION OF THE PREFERRED EMBODIMENTS

Figure 3:
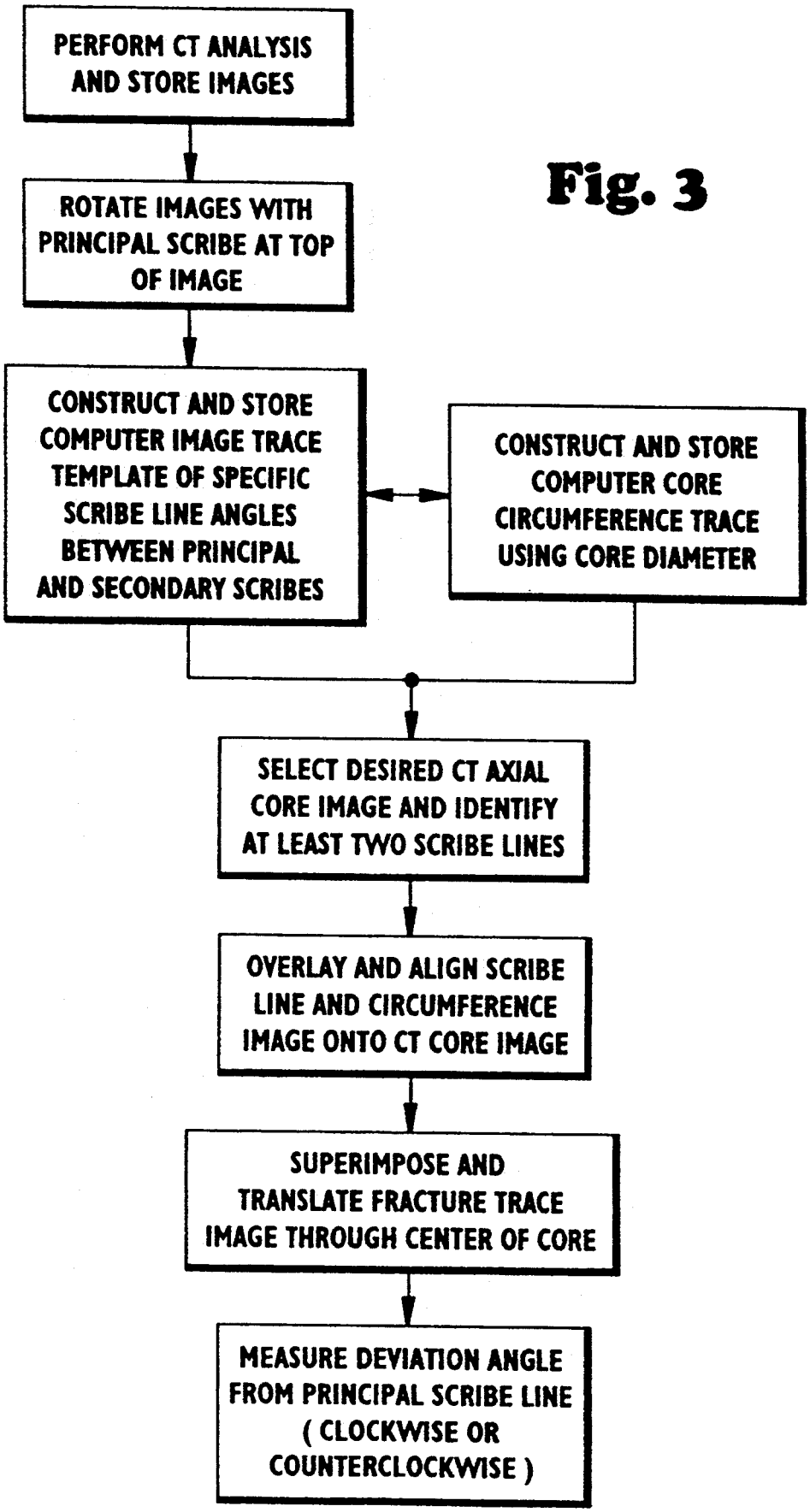
FIG. 3 is a flowchart representing the steps of a computer software program for measuring the orientation of a fracture.

Whenever a well is fractured, there is no way to assure at which of the perforation sites a fracture will initiate. Sometimes, the fractures initiate at a perforation site that is not aligned with the direction in which the fracture will propagate through the formation. Generally speaking, the initiation of a fracture at a perforation site is less dependant upon the direction of the perforation than it is upon the local stress conditions of the formation immediately adjacent to the perforation. In fact, whether a fracture initiates at a given perforation site is greatly affected by the extent of damage caused to the formation during the slotting process. Therefore, fractures may be initiated at nonaligned perforation sites, even though the initiation and propagation of a fracture at a nonaligned perforation site would, in theory, require higher pressures than would be required to initiate and propagate a fracture at a perforation site aligned with the direction of fracture propagation. In general, with the use of conventional slotting techniques, few, if any, of the slots produced would be aligned with the plane of an inferred fracture, such as that determined by a microfrac test.

By way of example only, assume that the direction of fracture propagation existing within a field is along a horizontal line that corresponds to the 0°–180° axis of a horizontal plane passing through the well bore when viewed from above. During fracturing operations, a fracturing fluid is pumped into the well bore under high pressure to induce and propagate the fracture. This operation may result in the initiation and propagation of a fracture in a nonaligned slot, e.g., a slot oriented at 30°. After the initial fracture has propagated a given distance away from the well bore, approximately 2–3 well bore diameters, the fracture will turn towards, or align with, a direction perpendicular to the minimum principal stress existing within the formation to reduce the energy required to propagate the fracture. This results in a curved flow path through which the fracturing fluid must be pumped to complete the fracturing operations. This phenomenon, which is commonly referred to as near well bore tortuosity, causes many problems during fracturing procedures.

The phenomenon of near well bore tortuosity may also occur under distinctly different circumstances. In particular, if a good seal is not achieved between the cement and the formation in a cased well, and if the fracturing fluid has access to the cement-formation interface, then fractures may be initiated on the surface of the well bore face in a direction perpendicular to the minimum principal stress in the formation, and not at one of the slot sites. Since the energy required to fracture the formation in the direction of the nonaligned slots is larger than the energy required to propagate the fractures at the well bore face, a curved or convoluted flow path for the fracturing fluid may be established between the slots and the fractures initiated at the well bore face as the fracturing fluid flows between the cement and the formation.

The near well bore tortuosity phenomenon can result in excessively high pressure drops as the fracturing fluid is pumped through the fractures initiated in the nonaligned slots. This curved flow path for the fracturing fluid may also result in fracture narrowing for two reasons. First, since the slot is not aligned with the natural direction of fracture propagation, the force required to induce and propagate the fracture initiated at the nonaligned slot necessarily exceeds the minimum principal stress in the field, thereby resulting in a narrower fracture than would be produced if the slots, and resulting fractures, were aligned with the direction of fracture propagation. Additionally, since a given well has a maximum allowable well head pressure, the pressure drop incurred in pumping the fracturing fluid through the nonaligned slots limits the energy available to propagate the main fracture fully into the formation, i.e., if excessive pressure drop is encountered in pumping the fracturing fluid through a fracture initiated at a nonaligned slot, then a lesser amount of energy will be available to further open the fractures and force them further into the formation.

Another problem that may be encountered is bridging the fracture with proppants typically used in fracturing procedures. In particular, if a fracture is aligned perpendicular to the direction of minimum principal stress, then the main body of the fracture may be as much as approximately ½" wide. However, in the case of fractures induced in nonaligned slots, the width of the fracture may be significantly narrower. Given that proppants typically used in fracturing fluids may be approximately 0.026" in diameter, there exists a real possibility that proppants may bridge in the narrower fractures initiated in nonaligned slots. If this occurs, then fracturing operations may be prematurely terminated which results in, at best, a very inefficient well.

Although the tortuous path created as a result of fractures being initiated in nonaligned slots is not directly observable from the surface during fracturing operations, the effects of near well bore tortuosity may be observed. In particular, if the fracturing fluid must be pumped at pressures substantially in excess of the pressure required to hold the fractures open, then it is likely that any additional pressure drop is associated with this phenomenon of near well bore tortuosity. Given the relatively short length of the initial fractures, if the pressure drop associated with the flow of fluid through the initial fractures is relatively large, then the high pressure drop must be due to the losses incurred in forcing the fracturing fluid through a very narrow fracture over such a short distance.

The present inventive method overcomes these as well as other problems existing due to this phenomenon by determining the direction of hydraulic fracture propagation existing within a formation and providing a means for aligning the slots produced with the direction of hydraulic fracture propagation.

In particular, the direction of fracture propagation may be determined using any of a variety of methods. Representative methods include: 1) performing an open hole microfrac test and thereafter taking an oriented core from below the bottom of the well bore, thereby allowing observation of the direction of the induced fracture in the core; 2) using computed tomography (CT) techniques to determine fracture direction and rock anisotropy from an oriented core that is obtained after an open hole microfrac test; 3) employing a high precision multi-armed caliper, such as the Total Halliburton Extensionmeter, to measure the bore hole deformation before and after fracturing to determine the fracture direction; 4) performing strain relaxation measurements on an oriented core obtained from the relevant area of observation to determine the direction of least principal stress existing within the field; and 5) using an oriented downhole tool, such as Halliburton's Circumferential Acoustic Scanning Tool (CAST), to provide a full bore hole image which allows direct observation of an induced fracture during fracturing operations. However, these methods are merely representative techniques that may be employed to determine the direction of fracture propagation, and should not be considered as specific limitations of this invention. Each of these methods will be discussed more fully herein.

Visual Observation Of The Direction Of An Induced Fracture In An Oriented Core The techniques and methods employed during the open hole microfrac test to determine the direction of fracture propagation are fully disclosed in U.S. Pat. No. 4,529,036, which is hereby incorporated by reference. Generally speaking, during an open hole microfrac test, microfractures are induced in an open hole well bore by pumping a relatively small amount of fracturing fluid into the well bore. Since this technique is employed in an open well bore, these fractures will naturally align with the direction of fracture propagation, i.e., perpendicular to the minimum principal horizontal stress existing within the formation. Additionally, this procedure results in the initiation of fractures in the formation for a given depth under the bottom of the open hole well bore.

Thereafter, an oriented core sample is taken from the formation. The orientation of the core is determined by certain orientation grooves, both principal and secondary scribe lines, that are marked on the core as the core is being cut. Knives inside the core barrel cut the scribe lines as the core enters the core barrel. The orientation of the principal scribe with respect to a compass direction is recorded prior to running the core barrel into the bore hole. Thus, one can determine the orientation of the principal scribe line from the compass readings at each recorded interval. The secondary scribe lines are used as a reference for identifying the principal scribe. A survey record will exist at the conclusion of the cored section which accurately reflects the orientation of the core's principal scribe line throughout the interval. Orientation of the core is considered a critical part of obtaining accurate orientation measurements of planar core features such as fractures.

Once the oriented core is removed from the well, it is visually inspected to determine the direction of fracture propagation. This method has the additional benefit that the fracture direction is determined from observation of a fracture existing below the well, i.e., as it exists in the formation in its natural state away from the effects of the drilling operations. Typically, this procedure may be used to determine the direction of fracture propagation above, below, and within the area of the formation under consideration.

Observation Of The Direction Of An Induced Fracture In An Oriented Core Through Use Of Computed Tomography Imagery Fracture orientation may also be determined through use of computed tomography (CT) techniques, commonly known in the medical field as CAT scanning ("computerized axial tomography" or "computed assisted tomography"). This method is the subject of a separate pending patent application which is also assigned to the assignee of the present application (application Ser. No. 07/897,256, filed Jun. 11, 1992, now U.S. Pat. No. 5,277,062).

In this method, fractures are induced in the formation through use of the microfrac technique, thereafter an oriented core is taken from the bottom of the well bore. However, in this method, the oriented core sample remains inside a sleeve surrounding the core throughout the analysis of the core. Although this technique may be employed on any type of formation, it is particularly useful when dealing with friable type formations that prohibit physical handling of the core sample. The CT techniques allows observation of the direction of fractures as well as orientation directions on the core, and thereby allow determination of the direction of fracture propagation.

By way of background, CT technology is a nondestructive technology that provides an image of the internal structure and composition of an object. What makes the technology unique is the ability to obtain imaging which represents cross sectional "axial" or "longitudinal" slices through the object. This is accomplished through the reconstruction of a matrix of x-ray attenuation coefficients by a dedicated computer system which controls a scanner. Essentially, the CT scanner is a device which detects density and compositional differences in a volume of material of varying thicknesses. The resulting images and quantitative data which are produced reflect volume by volume (voxel) variations displayed as gray levels of contrasting CT numbers.

Although the principles of CT were discovered in the first half of this century, the technology has only recently been made available for practical applications in the non-medical areas. Computed tomography was first introduced as a diagnostic x-ray technology for medical applications in 1971, and has been applied in the last decade to materials analysis, known as non-destructive evaluation. The breakthroughs in tomographic imaging originated with the invention of the x-ray computed tomographic scanner in the early 1970's. The technology has recently been adapted for use in the petroleum industry.

A basic CT system consists of an x-ray tube; single or multiple detectors; dedicated system computer system which controls scanner functions and image reconstructions and post processing hardware and software. Additional ancillary equipment used in core analysis include a precision repositioning table; hard copy image output and recording devices; and x-ray "transparent" core holder or encasement material.

A core may be laid horizontally on the precision repositioning table. The table allows the core to be incrementally advanced a desired distance thereby ensuring consistent and thorough examination of each core interval. The x-ray beam is collimated through a narrow aperture (2 mm to 10 mm), passes through the material as the beam/object is rotated and the attenuated x-rays are picked up by the detectors for reconstruction. Typical single energy scan parameters are 75 mA current at an x-ray tube potential of 120 kV. After image reconstruction, a cross-sectional image is displayed and the data stored on tape or directly to a computer disk. One example of obtaining image output through hard copies in the form of 35 mm slides directly from image disks which may then be reproduced into 8.5×11 inch photographic sheets directly from the slides. However, other output displays are possible and other image displays are readily available and known to those skilled in the art.

A cross sectional slice of a volume of material can be divided into an n×n matrix of voxels (volume elements). The attenuated flux of $N_o$ x-ray photons passing through any single voxel having a linear attenuation coefficient $\mu$ reduces the number of transmitted photons to N as expressed by Beer's law:

$$N/N_o = e^{-\mu/x}$$

where:

N=number of photons transmitted $N_o$=original number of emitted photons x=dimension of the voxel in the direction of transmitted beam $\mu$=linear attenuation coefficient (cm).

Material parameters which determine the linear attenuation coefficient of a voxel relate to mass attenuation coefficient as follows:

$$\mu = (\mu/\rho)\rho$$

where:

$(\mu/\rho)$ is the mass attenuation coefficient (MAC) and $\rho$ is the object density.

Mass attenuation coefficients are dependent on the mean atomic number of the material in a voxel and the photon energy of the beam [approx. $(KeV)^{-3}$]. For a heterogeneous voxel, i.e., compounds and mixtures, the atomic number depends on the weighted average of the volume fraction of each element (partial volume effect). Therefore, the composition and density of the material in a voxel will determine its linear attenuation coefficient.

Computed tomography calculates the x-ray absorption coefficient for each pixel as a CT number (CTN), whereby:

$$CTN = 1000\,\frac{\mu - \mu_w}{\mu_w}$$

where:

$\mu_w$ is the linear attenuation coefficient of water.

Conventionally, CT numbers are expressed as normalized MAC's to that of water. The units are known as Hounsfield units (HU) and are defined as O HU for water and (−1000) HU for air. Rearrangement of the previous equation can therefore be expressed as:

$$CTN\ (CT\ \text{number}) = 1000 \times ((\mu/\rho)\rho/(\rho/\rho)_w\rho_w - 1)$$

where:

$(\mu/\rho)_w$=mass attenuation coefficient of water $\rho_w$=density of water

Core lithology can be determined by single scan CT with the knowledge of the density (or grain density) and attenuation coefficient of the material. For sandstones, limestones, and dolomites, the grain densities are usually close to the mineral values found in the literature (2.65, 2.71, and 2.85 g/cm$^3$, respectively). Typical densities can also be used for rock or mineral types such as gypsum, anhydrite, siderite, and pyrite.

The mass attenuation coefficients of various elements and compounds can be found in the nuclear data literature. The mass attenuation coefficient for composite materials can be determined from the elemental attenuation coefficients by using a mass weighted averaging of each element in the compound as shown:

$$MAC = \frac{\Sigma M_i (MAC)_i}{\Sigma M_i}$$

where $M_i$ is the molecular weight for element i.

Note that calcite MAC values are higher than those for dolomite, even though dolomite has a higher grain density than calcite. This is because of the atomic number dependence. Water and decane have very similar MAC values. The higher atomic number (and MAC value) materials are more nonlinear with x-ray energy than the lower atomic number materials.

In general, sandstones or silicon-based materials have CT numbers in the 1000–2000 range, depending on the core porosity. Limestones and dolomites are typically in the 2000–3000 CTN range.

Small impurities of different elements in a core can change the core's CT numbers. For instance, the presence of calcium in a sandstone core matrix will increase the core's CT number above what would be predicted from the porosity vs. CTN curve. An estimate of the weight fraction of each element in the core can give a better estimate of the core porosity.

The occurrence of abrupt changes in CT number may indicate lithology discontinuities in the core. For instance, the presence of small high density/high CT number nodules (CTN<2000) usually indicates the presence of iron mineralization in the core (pyrite, siderite, glauconite). For limestones the presence of higher density/CTN nodules (CTN>3400) in the limestone matrix may indicate anhydrite in the core. A high CTN/high density region near the outer part of the core may indicate barite mud invasion.

Quantitative CT scanning of cores requires modifications to the techniques employed for medical applications. The CT scanner must be tuned for reservoir rocks rather than water in order to obtain quantitatively correct measurements of CT response of the cores. Since repeat scanning of specific locations in the sample is often necessary, more accurate sample positioning is required than is needed in medical diagnostics.

The specific techniques employed to determine the direction of fracture orientation by this method will now be discussed. Prior to coring the targeted reservoir, a fracture is induced by a microfrac treatment. Typically, drilling is stopped once the desired area of testing has been reached, i.e., after penetrating the top of the formation. An open hole expandable packer is set in the bore hole above the formation to be tested. Typically, the packer would be set to expose 10–15 feet of hole. A microfrac treatment uses a very slow injection rate and 1–2 barrels of drilling mud or other suitable fluid to create a small fracture in the formation.

After the microfrac treatment is terminated, the open hole packer is removed from the bore hole. The microfrac is followed by the drilling and recovery of an oriented core specimen from the formation (the orientation of a core sample has been discussed previously). This core will contain part of the actual fracture or fractures created during the microfracture treatment. The orientation of the induced fracture or fractures will indicate the direction of the least principal stress as the fracture will propagate in a direction perpendicular to the least principal stress.

The core would preferably be contained in a core tube which is removed at the surface from the core barrel used to cut the core. The core tube is typically made of fiberglass, aluminum or other suitable materials. The depth of the cored interval is noted on the core tube as it is removed from the core barrel. The core tube with the core inside is sent to a lab having computed tomography facilities for analysis.

The core tube, with the core inside, may be preferably placed horizontally on a precision repositioning table. A computerized tomographic scanner (CT scanner) will take a series of two dimensional slice images of the core. These slice images can be used individually or collectively for analysis or may be reconstructed into three dimensional images for analysis. The scanner consists of a rotating x-ray source and detector which circles the horizontal core on the repositioning table. The table allows the core to be incrementally advanced a desired distance thereby ensuring consistent inspection of each core interval. X-rays are taken of the core at desired intervals. The detector converts the x-rays into digital data that is routed to a computer. The computer converts the digital x-ray data into an image which can be displayed on a CRT screen. These images are preferably obtained in an appropriate pixel format for full resolution. A hard copy of the image can be obtained if desired. The image represents the internal structure and composition of the core and/or fractures.

CT images can be obtained which represent cross-sectional "axial" or "longitudinal" slices through the core. Axial and longitudinal scan slices are illustrated in FIGS. 1*a* and 1*b*, respectively. For axial images, CT scan images are taken perpendicular to the longitudinal axis of the core. A longitudinal image is created by reconstructing a series of axial images. Images can be obtained along the entire length of the core at any desired increment. Slice thickness typically range from 0.5 mm to 2.0 mm. The images thus obtained can discern many internal features within a formation core including cracks, hydraulic and mechanically induced fractures, partially mineralized natural fractures and other physical rock fabrics. These features are represented by CT numbers which differ from the CT number of the surrounding rock matrix. A CT number is a function of the density and the atomic number of the material. For a given mineralogy, a higher CT number represents a higher density and therefore a lower porosity. Due to the high CT number contrast between an opened induced fracture and the surrounding rock matrix, the induced fracture can be observed directly in the images even though a narrow hairline fracture may not be readily observed on the outside perimeter of the core.

FIG. 2 represents a schematic of the procedure for obtaining fracture orientation from a CT image. Using an axial slice image from the recovered core, the CT computer generates a circumferential trace 10 about the circumference of the core image. The principal and secondary scribe marks on the oriented core will appear as indentation on the circumference of the scan image. From these indentations, the computer generates the principal 12 and secondary 13 scribe lines on the image. The intersection of the principal and secondary scribe lines coincide with the geometric center 14 of the image. The induced fracture 15 is then identified on the core image. Since a fracture will rarely be in the center of the core, it is necessary to translate the fracture orientation to the center of the core image.

A trace of the fracture is created by translating and projecting the fracture orientation through the geometric center 14 of the circumference of the core, as indicated by the arrows in FIG. 2. The fracture trace 16 will be parallel to the induced fracture 15 identified in the scan image. The angle between the principal scribe 12 and the fracture trace 16 is measured along the circumferential trace of the core image with a positive (clockwise) or negative (counterclockwise) angle. In other words, compass direction or azimuthal strike orientation is measured from the principal scribe to where fracture trace 16 intersects the circumferential trace of the core image. When the compass orientation for the principal scribe mark at the image core depth is determined from the core orientation data, the angle between the principal scribe line and the fracture trace is then converted to azimuthal orientation with respect to true north. This process can be performed through manual measurements or automatically through a computer software program which performs the angle measurement and calculation. A flow chart representing the steps of a computer software program for measuring the orientation of a fracture is illustrated in FIG. 3. The strike orientation of other planar rock features may also be determined by the same procedure.

Two example calculations of induced fracture strike orientation are provided for clockwise and counterclockwise angle measurements from the principal scribe. The following formula is used in the calculation:

$$S_1+D=S_2$$

where:

$S_1$=Principal scribe orientation at an indicated depth in degrees east or west of north from 0 to 90.

D=Angle deviation from the principal scribe of the fracture trace projected through the core center intersected at the core perimeter. Clockwise angles from the principal scribe are designated as positive values. Counterclockwise angles from the principal scribe are designated as negative values.

$S_2$=Resultant induced fracture strike orientation with respect to true north (degrees east or west of north).

NOTE: The sign of the deviation angle (D) will be reversed when $S_2$ changes from the NE to the NW quadrant.

EXAMPLE 1

Extrapolated $S_1$ orientation from true north=N52E.
CT measured deviation angle D=+8
$S_1+D=S_2$
52+(+8)=60 degrees
Induced fracture strike orientation ($S_2$)=N6OE

EXAMPLE 2

Extrapolated $S_1$ orientation from true north=N81.5E.
CT measured deviation angle D=−22
$S_1+D=S_2$
81.5+(−22)=58.5 degrees
Induced fracture strike orientation ($S_2$)=N58.5E Both examples were obtained from identified induced fractures obtained at two different depth markers from an oriented core retrieved from competent Devonian shale in Roane Co. West Virginia. Note consistency of induced fracture strike despite rotation of the principal scribe orientation in the recovered core.

Figure 4:
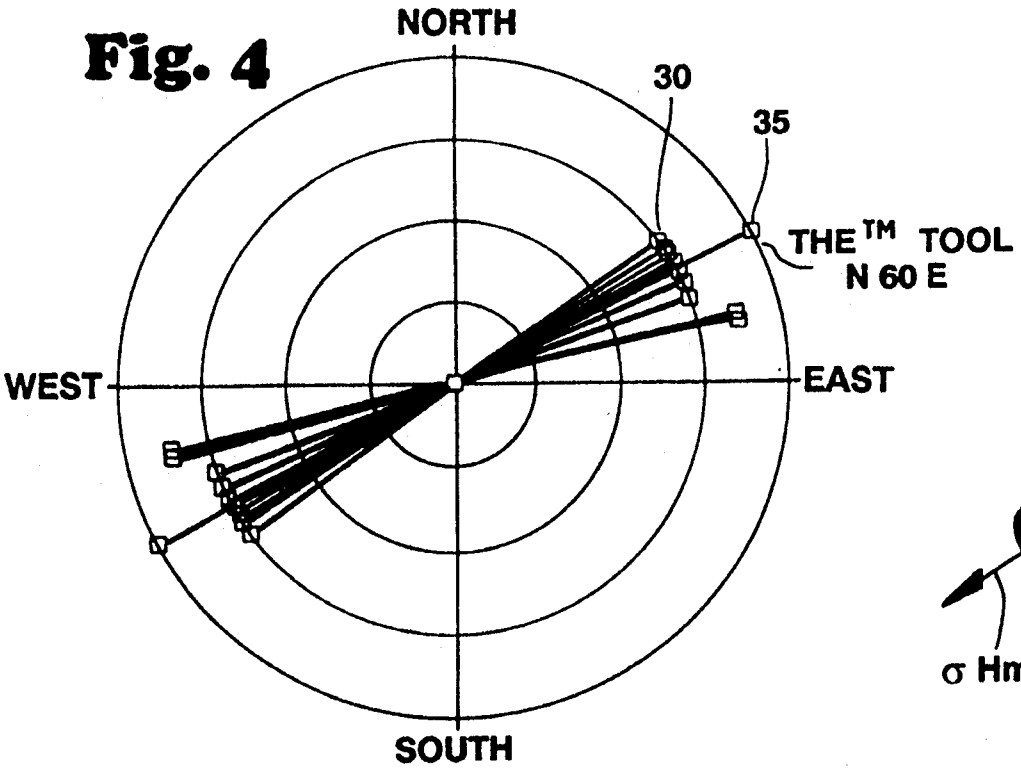
FIG. 4 is an induced fracture strike orientation plot.

FIG. 4 shows a series of induced fracture data points, identified collectively as 30, at two different core depths in two core intervals. As can be seen in FIG. 4, this data supports the single point downhole hydraulic fracture orientation obtained from a downhole extensiometer device, 35, in the same well, with the median of 11 core induced data points being within 2 degrees of the inferred hydraulic fracture orientation obtained by use of the Total Halliburton Extensionmeter, another technique fully disclosed herein. The data points shown in FIG. 3, were obtained from the Devonian shale described above, in Roane Co., W. Va. The orientation of the minimum in-situ stress would be inferred to be substantially perpendicular to the induced fracture orientation, which in FIG. 4 would be approximately N30W.

Figure 5:
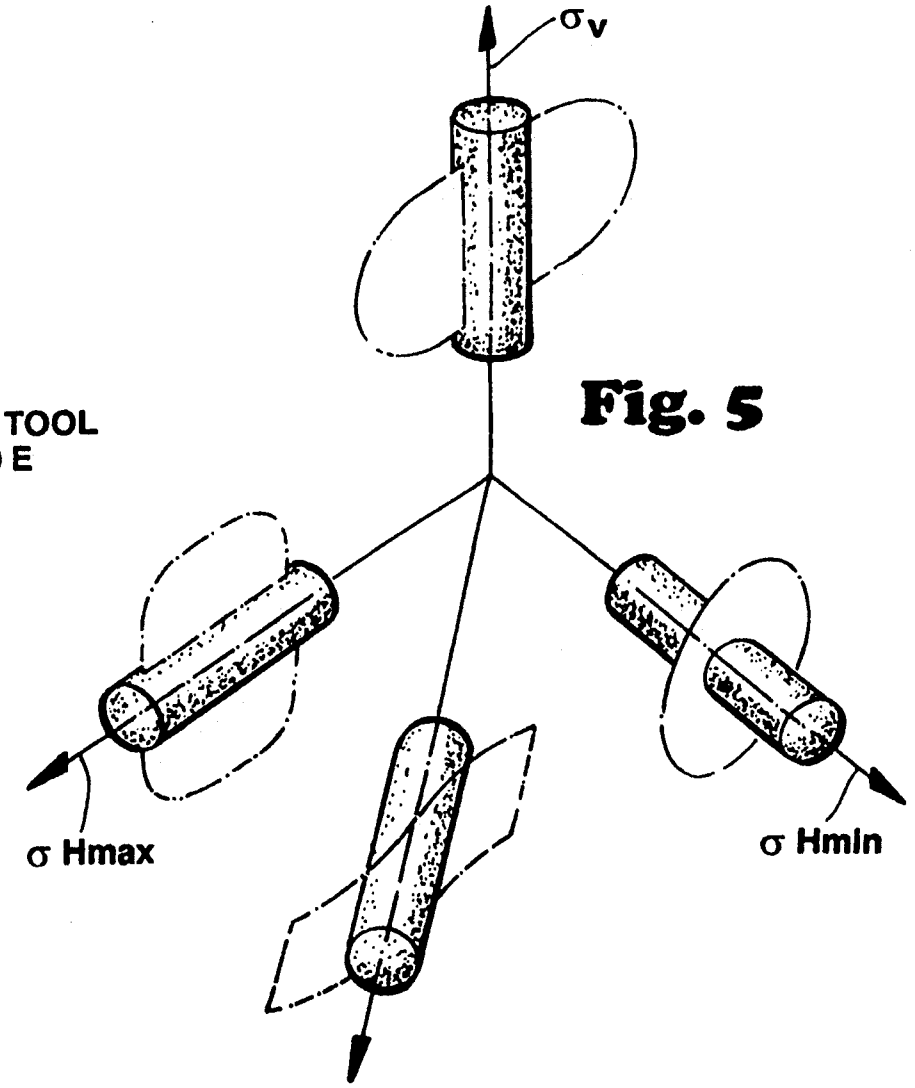
FIG. 5 illustrates the generalized fracture orientation with respect to well bore orientation and stress orientation.

FIG. 5 is a three dimensional view of the relationship between the orientation of induced fractures and minimum and maximum stress orientation, where:

$\sigma_{Hmax}$=maximum in-situ horizontal stress orientation $\sigma_{Hmin}$=minimum in-situ horizontal stress orientation $\sigma_v$=vertical stress orientation.

The orientation of the induced fracture will be perpendicular to the minimum in situ stress as shown on the $\sigma_{Hmin}$ axis and parallel to the maximum in situ stress as shown on the or $\sigma_{Hmax}$ axis. The induced fracture orientation will be at an approximately 45° angle to the core when the core is oriented at 45° angle to the maximum and minimum in situ stress. The orientation of the induced fracture will change with respect to the well bore but not with respect to the minimum and maximum in situ stress orientation.

Figure 6:
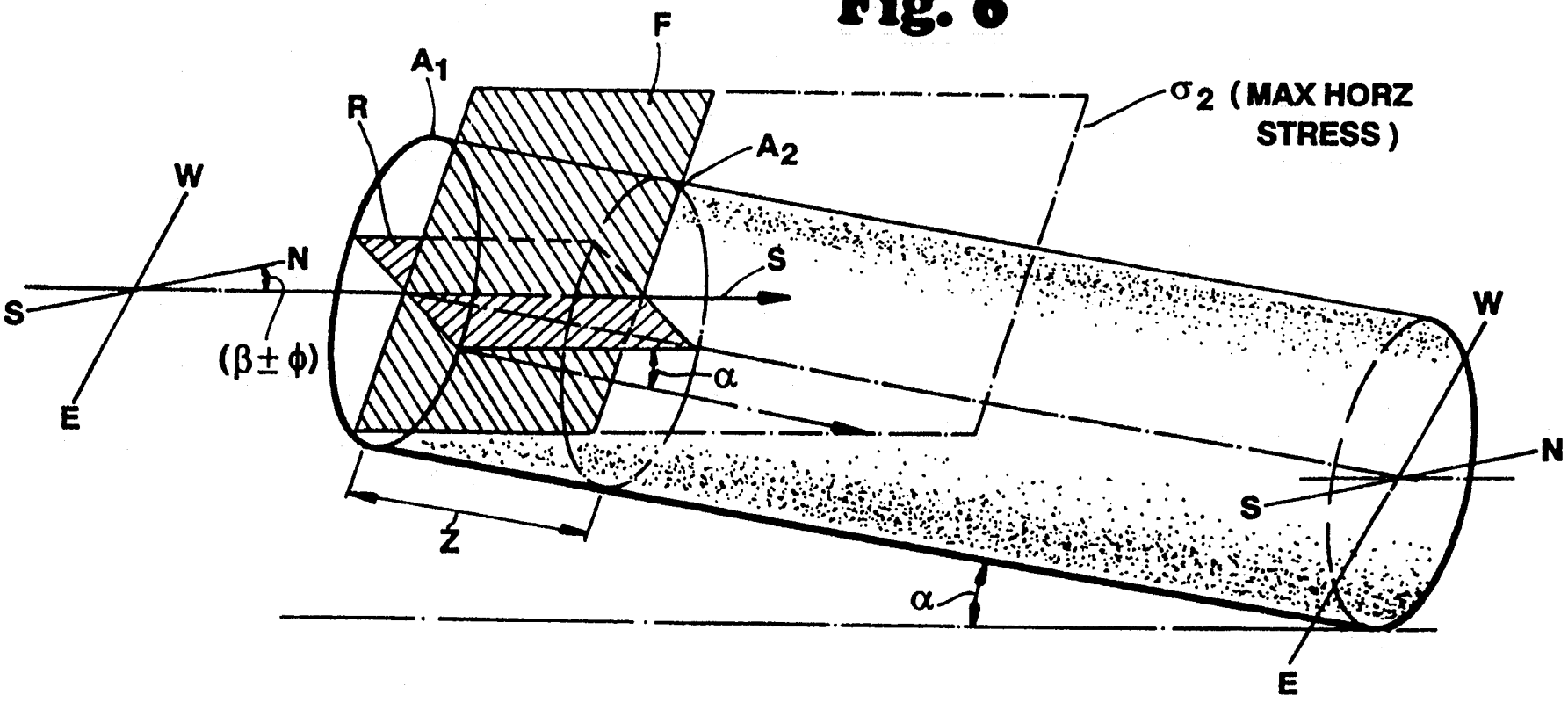
FIG. 6 is a graphical solution to the fracture orientation for deviated or horizontal well bore/core.

In a vertical well, the images are taken in a perpendicular plane to the vertical axis of the well. As a result, the strike orientation can be determined directly in relation to the principal scribe orientation which is recalculated with respect to compass direction or azimuth. In a deviated well, the apparent strike must be corrected for the deviation. In addition, the spatial orientation can be determined by calculating dip angle and direction from sequential slice images. FIG. 6 illustrates a graphical solution for measuring the fracture orientation in a deviated or horizontal well using CT imagery where:

F=plane of induced fracture;

S=line of induced fracture strike;

$A_1$ to $A_2$=a series of sequential axial CT slice images from interval Z;

R=plane of longitudinal reconstructed CT image in horizontal plane:

$\alpha$=angle of well bore deviation from horizontal plane;

$\phi$=angle of well bore deviation form North;

$\beta$=angle of fracture trace deviation from $\phi$; and $\beta+\phi$=strike orientation from North.

The CT computer can be used to construct a longitudinal or horizontal image by reconstructing a series of axial slices. The fracture trace on the reconstructed longitudinal or horizontal image will represent the strike orientation. The same process as described above for a vertical well is then used to measure the azimuthal direction of the fracture trace.

Determining The Direction Of Fracture Propagation Through Measurement Of Bore Hole Deformations A highly sensitive multi-arm caliper, such as the Total Halliburton Extensionmeter, may also be used to determine the direction of fracture propagation. That tool is the subject of U.S. Pat. No. 4,673,890, which is hereby incorporated by reference. Other downhole tools that may be used to measure bore hole deformations are depicted in U.S. Pat. Nos. 4,625,795 and 4,800,753, both of which are hereby incorporated by reference.

This method is the subject of a separate pending patent application which is also assigned to the assignee of the present application (application Ser. No. 07/902,108, filed Jun. 22, 1992, now U.S. Pat. No. 5,272,916). This method basically comprises the steps of exerting pressure on a subterranean formation by way of the well bore, measuring the diametral displacements of the well bore in three or more angularly offset directions at a location adjacent the formation as the pressure of the formation is increased, and then comparing the magnitudes of the displacements to detect and measure elastic anisotropy in the formation. The measurement of the in-situ elastic anisotropy in the form of directional diametral displacements at increments of pressure exerted on the formation are utilized to calculate directional elastic moduli in the rock formation and other factors relating to the mechanical behavior of the formation.

In carrying out this method, a well bore is drilled into or through a subterranean formation in which it is desired to determine fracture related properties, e.g., the relationship between applied pressure and well bore deformation which allows the calculation of in-situ rock elastic moduli and in-situ stresses. A knowledge of such fracturing related properties of a rock formation, as well as fracture direction and fracture width as a function of pressure prior to carrying out a fracture treatment in the formation, allows the fracture treatment to be planned and performed very efficiently, whereby desired results are obtained. In addition, knowing the fracture direction allows the optimum well spacing in a field to be determined as well as the establishment of the shape of the drainage area and the optimum placement of both vertical and horizontal wells.

Figure 7:
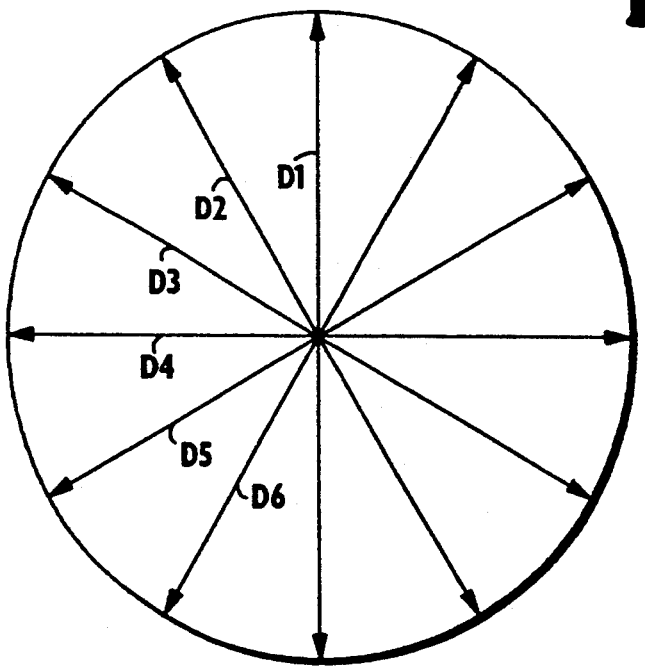
FIG. 7 represents a horizontal cross-section through a vertical well bore showing the angularly offset directions in which well bore diametral displacements are preferably measured.

Prior to casing or lining a well bore penetrating a formation to be tested, a measurement tool of the type described in U.S. Pat. No. 4,673,890 is lowered through the well bore to a point adjacent the formation in which fracture related properties are to be determined. The measurement tool includes packers whereby it can be isolated in the zone to be tested, and radially extendable arms are provided which engage the sides of the well bore and measure initial diameter and diametral displacements in at least two angularly offset directions. Preferably, the measurement tool includes six pairs of oppositely positioned radially extendable arms whereby diameters and diametral displacements are measured in six equally spaced angularly offset directions as shown in FIG. 7. The measurement tool must have sufficient sensitivity to measure incremental displacements in micro inches.

After isolation, and once the extendable arms are in firm contact with the walls of the well bore adjacent the formation to be tested, the tool continuously measures diametral displacements as the pressure exerted in the well bore is increased. Generally, the measurement tool is connected to a string of drill pipe or the like and after being lowered and isolated in the well bore adjacent the formation to be tested, the pipe and the portion of the well bore containing the measurement tool are filled with a fluid such as an aqueous liquid. The measurement tool then measures the initial diameters of the well bore in the angularly offset directions at the static liquid pressure exerted on the formation. The measurement tool is azimuthally orientated so that the individual polar directions of the measurements are known.

Figure 8:
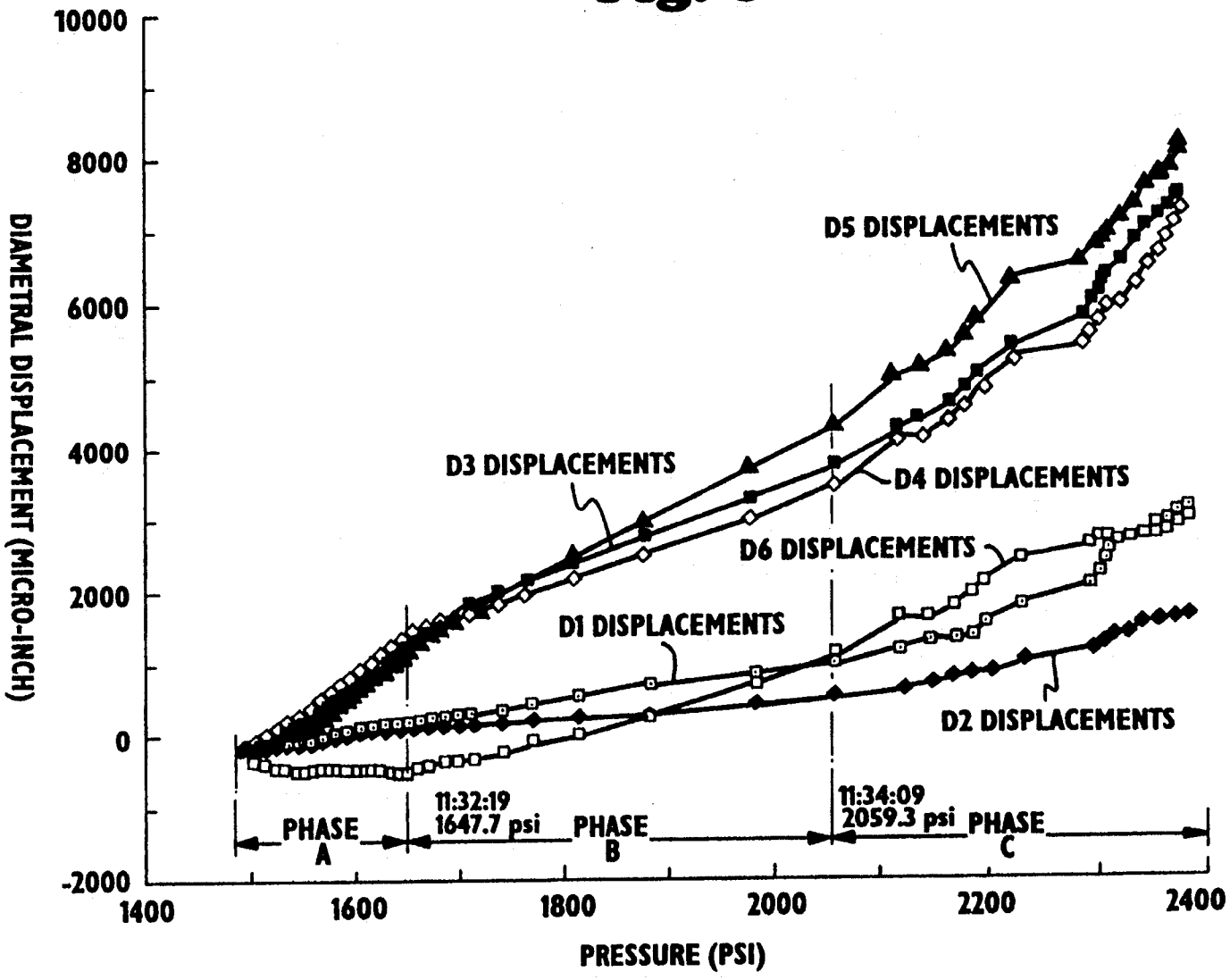
FIG. 8 is a graph showing the diametral displacements of a well bore versus pressure.

Additional fluid is pumped into the well bore thereby increasing the pressure exerted on the formation adjacent the measurement tool from the static fluid pressure to a pressure above the pressure at which one or more fractures are created in the formation. As the pressure is increased, the directional diametral displacements of the well bore are measured at a minimum of two and preferably at a plurality of pressure increments. For example, the directional diametral measurements can be simultaneously made once each second during the time period over which the pressure is increased. The measurements are recorded and processed electronically whereby the magnitudes of the diametral displacements in the various directions can be compared, e.g., graphically as shown in FIG. 8. In-situ elastic anisotropy in the formation is shown if the magnitudes of the diametral displacements are unequal. Thus, the measurements are used to detect whether or not the rock formation being tested is in a state of elastic anisotropy, and the measurement data corresponding to pressure exerted on the formation is utilized to calculate in-situ rock moduli and other rock properties relating to fracturing. When the formation fractures, the measurement data at the time of the fracture, and thereafter, is utilized to determine fracture direction and fracture width as a function of pressure.

Thus, the method of the present invention basically comprises the steps of exerting increasing pressure on a formation by way of the well bore, measuring the incremental diametral displacements of the well bore in three or more angularly offset directions at a location adjacent the formation as the pressure on the formation is increased, and then comparing the magnitudes of the diametral displacements to determine if they are unequal and to thereby detect and measure elastic anisotropy in the formation.

The angularly offset directions are azimuthally oriented, and the incremental diametral displacements are preferably measured in a plurality of equally spaced angularly offset directions. Once the azimuthal orientation of formation anisotropy is known, the tool may be reoriented for the purpose of directly measuring maximum and minimum displacements aligned in the inferred plane of minimum and maximum stress.

Once the in-situ elastic anisotropy of a subterranean formation has been detected and measured as described above, directional elastic moduli, i.e., Young's modulus and/or shear modulus are determined using the pressure correlated displacement data obtained. That is, the Young's modulus of the formation in each direction is determined using the following formula:

$$E = \frac{(P_2 - P_1)D}{(W_2 - W_1)}(1 + \mu)$$

wherein E represents Young's Modulus;

$P_1$ represents a first pressure;

$P_2$ represents a greater pressure;

D represents the initial well bore diameter;

$W_1$ represents the diametral displacement of the well bore at the first pressure ($P_1$); and $W_2$ represents the well bore diametral displacement at the second pressure ($P_2$); and $\mu$ represents Poisson's Ratio.

Young's modulus values obtained in accordance with this invention using the above formula are close approximations of the actual Young's modulus values of the tested formation in the directions of the well bore measurements. Young's modulus can be defined as the ratio of normal stress to the resulting strain in the direction of the applied stress, and is applicable for the linear range of the material; that is, where the ratio is a constant. In an anisotropic material, Young's modulus may vary with direction. In subterranean formations, the plane of applied stress is usually defined in the horizontal plane which is roughly parallel to bedding planes in rock strata where the bedding is horizontally aligned.

Poisson's ratio ($\mu$) can be defined as the ratio of lateral strain (contraction) to the axial strain (extension) for normal stress within the elastic limit.

Young's modulus is related to shear modulus by the formula:

$$E=2G(1+\mu)$$

wherein

E represents Young's modulus;

G represents shear modulus; and

Shear modulus can be defined as the ratio of shear stress to the resulting shear strain over the linear range of material.

Thus, once the approximate Young's modulus in a direction is calculated, shear modulus can also be calculated. Both shear modulus and Young's modulus are based on the elasticity of rock theory and are utilized to calculate various rock properties relating to fracturing as is well known by those skilled in the art. The term stress, as it is used here, can be defined as the internal force per unit of cross-sectional area on which the force acts. It can be resolved into normal and shear components which are perpendicular and parallel, respectively, to the area. Strain, as it is used herein, can be defined as the deformation per unit length and is also known as "unit deformation". Shear strain can be defined as the lateral deformation per unit length and is also known as "unit detrusion". The term "elastic moduli" is sometimes utilized herein to refer to both shear modulus and Young's modulus. The directional diametral displacement and elastic moduli data obtained in accordance with this invention can be utilized to verify in-situ stress orientation, verify or predict hydraulic fracture direction in the formation, and to design subsequent fracture treatments using techniques well known to those skilled in the art.

A preferred method for detecting and measuring in-situ elastic anisotropy in a subterranean rock formation penetrated by a well bore generally comprises the steps of:

(a) placing a well bore diameter and diametral displacement measurement tool in the well bore adjacent the formation, the tool being capable of measuring well bore initial diameters and diametral displacements in a plurality of azimuthally oriented angularly offset directions at an initial pressure and at two or more successive pressure increments;
(b) exerting initial pressure on the formation by way of the well bore;
(c) increasing the pressure exerted on the formation;
(d) measuring the diameters at the initial pressure and the diametral displacements at the two or more successive pressure increments in each of the azimuthally oriented angularly offset directions;
(e) comparing the magnitudes of the diametral displacements to determine if they are unequal to thereby detect and measure in-situ elastic anisotropy in the formation; and
(f) determining the approximate in-situ Young's modulus of the rock formation in each of the directions by multiplying the difference in pressure between two of the pressure increments by the initial diameter of the well bore and by 1 plus Poisson's ratio and dividing the product obtained by the difference between the diametral displacements at the pressure increments.

A representative example of this method follows:

EXAMPLE

A well bore measurement tool of the type described in U.S. Pat. No. 4,673,890 was used to test a subterranean formation. The measurement tool, connected to a string of tubing, was lowered to a location in the well bore adjacent the formation to be tested that had been cored to a diameter of 7 7/8", and the measurement tool was isolated by setting top and bottom packers. The string of tubing was filled with an aqueous liquid and the annulus between the tubing and the walls of the bore was pressured with nitrogen gas.

The measurement tool included six pairs of opposing radially extendable arms whereby initial diameters and diametral displacements were measured in a substantially horizontal plane in six angularly offset directions designated D1 through D6 as shown in FIG. 7. After the arms were extended and stabilized against the walls of the well bore, the measurement tool was activated. Measurements were made and processed as the liquid pressure exerted on the formation was increased from the initial static liquid pressure by pumping additional liquid through the tubing against and into the tested formation at a rate of 3 gallons per minute.

The diametral displacement measurements made by the measurement tool while the pressure was increased from about 1490 psi (static liquid pressure) to about 2380 psi are presented graphically in FIG. 8. As shown, the diametral displacements are not equal thereby indicating elastic anisotropy. The data presented in FIG. 8 covers the period from the start of pumping 11:21:35 a.m. to fracture initiation at 11:37:19 a.m. During that period, the testing went through three distinct phases indicated in FIG. 8 by the letters A, B and C. In phase A, the measured displacements were not linear and remained substantially constant in the directions D1, D2 and D6 indicating a hard quadrant while D3, D4 and D5 changed dramatically indicating a soft quadrant. The cause for the non-linearity is speculated to be movements associated with further seating of the arms and/or the closing of micro fractures in the formation. At a pressure of about 1647.7 psi and time of 11:32:19 a.m., the early nonlinearity came to an end, and a second phase (phase B) began during which the diametral displacements were generally linear. Phase B continued to the time of 11:34:09 a.m. and a pressure of 2059.3 psi whereupon the fracturing phase (phase C) began and the displacements again became non-linear.

When a fracture was induced at 11:37:19 a.m. there was a sudden change in the reading and shifting of the instrument. Prior to the shifting, seven one second diametral displacement readings were obtained from which the width of the induced fracture (the displacement in a direction perpendicular to the fracture direction) was determined to approximately 0.027 inches and the fracture direction was determined to N 67° E (magnetic).

The directional stress moduli of the test formation were calculated using the linear displacement data obtained during phase B of the test period shown in FIG. 8. The calculations were made using the formulae set forth above, and the results are as follows:

| Direction | $W_1$, μ-inches | $W_2$, μ-inches | $W_2$—$W_1$, μ-inches | E, $10^6$ psi |
|---|---|---|---|---|
| D1 | 343 | 1244 | 901 | 4.50 |
| D2 | 267 | 701 | 434 | 9.34 |
| D3 | 1670 | 4112 | 2442 | 1.66 |
| D4 | 1603 | 3882 | 2279 | 1.78 |
| D5 | 1508 | 4697 | 3189 | 1.27 |
| D6 | −350 | 1375 | 1725 | 2.35 |

From the values set forth above, it can be seen that the smallest difference between $W_2$ and $W_1$ took place in the direction D2 and the calculated Young's modulus is greatest in the direction D2. In this example, the fracture direction also corresponds to D2.

Figure 9:
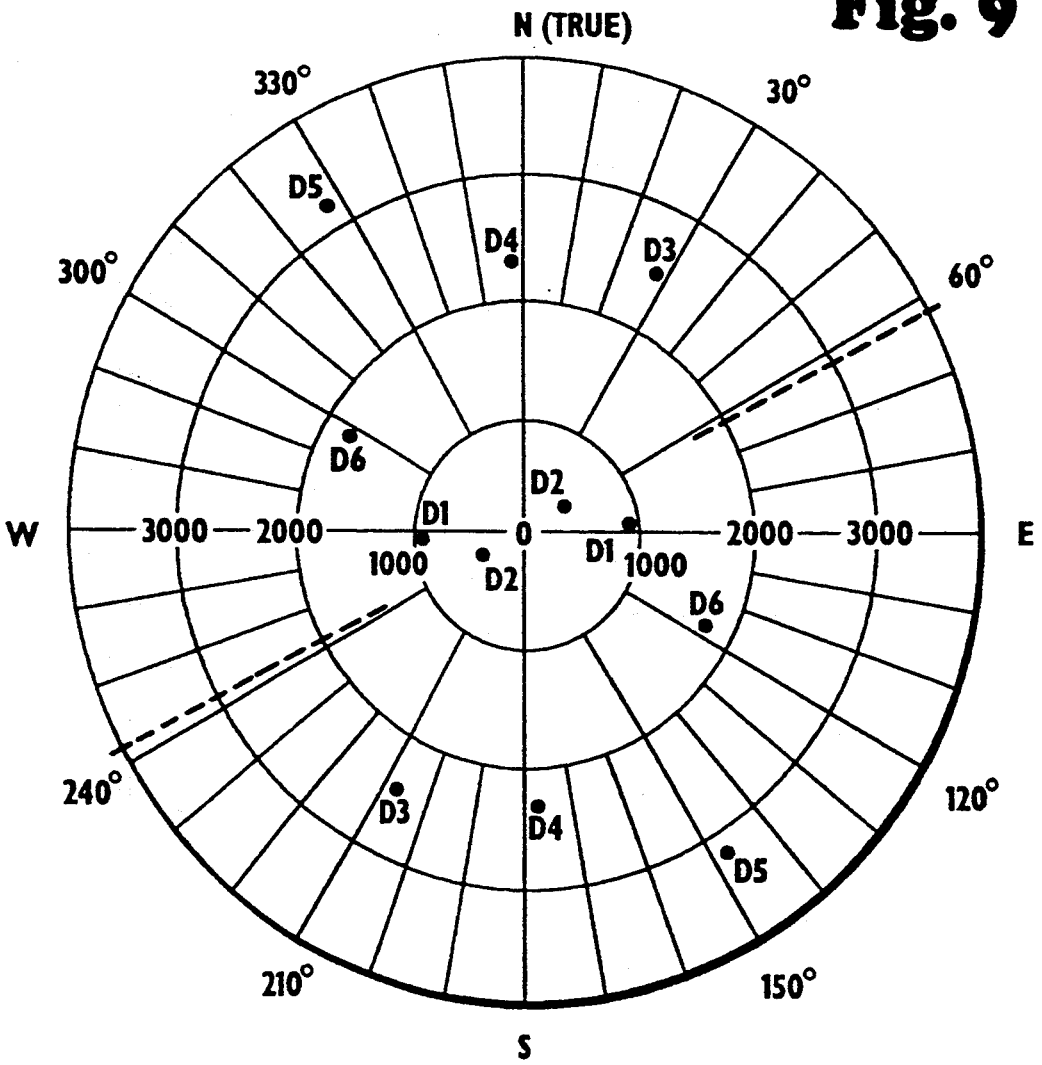
FIG. 9 is a polar graph showing the diametral enlargements of a well bore as a result of the pressure increase over the time period identified as phase B in FIG. 8.

Referring now to FIG. 9, a polar plot of the differences in the displacements ($W_2-W_1$) in μ-inches for D1 through D6 is presented, and the fracture direction indicated by the measuring tool of N 67° E is shown in dashed lines thereon. As shown in FIG. 9, the actual fracture direction substantially corresponds with the direction D2 in which the least well bore diametral displacement difference took place and in which direction the formation had the highest elastic moduli.

Determining Fracture Orientation Through Strain Relaxation Measurement Techniques Additionally, fracture orientation may also be determined from strain relaxation measurements of an oriented core. This technique is well known in the prior art and fully discussed in the following papers, all of which are hereby incorporated by reference: (1) Teufel, L. W., *Strain Relaxation Method for Predicting Hydraulic Fracture Azimuth from Oriented Core*, SPE/DOE 9836 (1981); (2) Teufel, L. W., *Prediction of Hydraulic Fracture Azimuth From Anelastic Strain Recovery Measurements of Oriented Core*, Proceeding of 23rd Symposium on Rock Mechanics: Issues in Rock Mechanics, Ed. By R. E. Goodman and F. F. Hughes, p. 239, SME of AIME, New York, 1982; (3) Burton, T. L., *The Relation Between Recovery Reformation and In-Situ Stress Magnitudes*, SPE/DOE 11624 (1983); (4) El Rabaa, W. and Meadows, D. L., *Laboratory and Field Application of the Strain Relaxation Method*, SPE 15072 (1986); (5) El Rabaa, W., *Determination of the Stress Field and Fracture Direction in the Danian Chalk*, 1989.

In order to predict the azimuth of a hydraulic fracture, it is necessary to know the direction of the minimum horizontal compressive stress, because a hydraulic fracture propagates perpendicular to this stress direction. The strain relaxation method as outlined by Teufel, is based upon the assumption that an oriented sample of the formation, when retrieved from its downhole confined conditions, will relax (creep) in all directions. The magnitude of the recovered strain in any direction is proportional to the magnitude of the stress in that direction. Therefore, most recovered strain is aligned with the direction of maximum in-situ stress, or the direction of propagation of an induced hydraulic fracture. By instrumenting an oriented core immediately after its removal from the core barrel, a portion of the total recoverable strain can be measured.

In general, the following are the idealistic core properties demanded by the method to produce reliable results:

1. The core must be homogeneous and linearly viscoelastic. The core should also exhibit an isotropic creep compliance D(t) while maintaining a constant value of Poisson's ratio, i.e., Poisson's ratio is not time dependent;
2. The core must be free of cracks; and
3. It is preferable that the core is thermally isotropic, i.e., it has an equal coefficient of thermal expansion in all directions.

Prediction of fracture azimuth from three diametrical measurements of a core requires that (1) the in-situ principal stresses not be equal, and (2) the maximum stress be oriented in the vertical direction (due to the overburden weight). Despite variations found in formation properties (except for cracks), the method has been successfully applied.

The time dependent deformation that a core displays after its retrieval from a deep well is a result of displacements caused by the following effects:

1. Release of in-situ stresses, which consists of the overburden stress and the in-situ horizontal stresses;
2. Changes in core temperature; and/or
3. Release of pore pressure (what is left from the endogenous reservoir pressure plus that created by the drilling fluids).

Thus, for a core (with idealistic properties) taken from a vertical well, the change in its diameter for a specific period of time can be expressed by equation (1).

$$\Delta D = \Delta D_{st} - (\Delta D_p + \Delta D_{ov} + \Delta D_t)$$

where $\Delta D$ is the total displacement of the core diameter, and $\Delta D_{st}$, $\Delta D_p$, $\Delta D_{ov}$, $\Delta D_t$ are the diametrical displacements due to release of horizontal stresses, pore pressure, overburden and temperature changes, respectively. The total displacement could be positive or negative, i.e., cores could show expansion or contraction during the relaxation period. However, the only directional displacements are caused by release of (unequal) in-situ horizontal stresses (assuming that all other effects cause only non-directional diametrical deformation). Therefore, according to strain relaxation theory, the direction of maximum stress is taken as parallel to the direction of the core experiencing the most expansion during relaxation, or perpendicular to the direction of most contraction by superposition principles, thereby allowing determination of fracture orientation. Core contraction caused by release of pore pressure and loss of moisture can be minimized or prevented by sealing the core; however, this method is not always successful.

The specific techniques employed by this method generally involve taking an oriented piece of core from the bottom section of the core barrel (cores cut last) immediately upon its retrieval from the well bore. (The core piece must be the most homogeneous and crack-free available.) After cleaning the core sample, it as sealed with a fast drying sealer or wrapped in a polyethylene wrapper.

The equipment used in this method includes a device base, displacement transducers, (3) aluminum ring (transducer carrier), and connecting rods. The aluminum ting can fit around a core piece of up to 4.25 in. diameter. The ring holds three pairs of DC displacement transducers to monitor three core diameters 60° apart and named X, Y and Z axes. Transducer output is 400 microvolts per $\pm 1\ \eta\epsilon$ (unit of strain) deformation of 4 in. diameter core. This output is measurable without amplification (unlike cantilever type devices utilizing strain gauges). The ring is adjustable up and down the core to accommodate various lengths of core up to 12 in. Vertical positioning of the ring allows one to choose the most homogeneous location for taking measurements along the core length.

The core piece is held independently of the ring in the center of the device by six adjustable arms. To account for the temperature effect on the device output, temperature is measured in two opposite places in the ring.

Since the measured displacements (strains) are 60° apart, the direction of the principal strains can be calculated by the following equation:

$$\theta = 1/2\tan^{-1}\frac{\sqrt{3}\,(\xi_y - \xi_z)}{2\xi_x - (\xi_y + \xi_z)}$$

where:

$\theta$ is the acute angle from the X-axis to the nearest principal axis. Terms $\epsilon_x$, $\epsilon_y$, and $\epsilon_z$ are the measured strain in the X, Y and Z axes respectively. Magnitude of maximum and minimum principal strains are calculated from the following equations:

$$\xi_{Hmax} = 1/3[\xi_x + \xi_y + \xi_z + \sqrt{2[(\xi_x - \xi_y)^2 + (\xi_y - \xi_z)^2 + (\xi_z - \xi_x)^2]}\,]$$

$$\xi_{Hmin} = 1/3[\xi_x + \xi_y + \xi_z - \sqrt{2[(\xi_x - \xi_y)^2 + (\xi_y - \xi_x)^2 + (\xi_z - \xi_x)^2]}\,]$$

Core relaxation monitoring begins after installing the core in the center of a transducer support ring device with its bottom end pointing downward (or as it was in the core barrel). A known angle between a major scribeline on the core sample and the X-axis of the device must be maintained in all tests for future azimuth correction. Pre-test preparations usually take 15–30 minutes. Core displacements and temperature of the device were logged at regular (10–30 min) intervals. It is desirable to conduct measurements in a constant or nearly stable temperature (±2° C.) environment. Measurements were taken until the next core was ready for testing or until complete stabilization status was reached. Calibration of the device was done on-site before and after tests using a totally relaxed homogeneous rock sample having a diameter similar to the one tested.

In applying the technique to actual field situations, there is one obvious, major complication. In analyzing an oriented core from a deep well, the strained measurements of the initial elastic recovery and part of the time-dependent (creep) recovery will be lost because of the finite time it takes to core the rock and bring the core to the surface. Since the elastic strain relief is unknown, it is essential to begin monitoring the time-dependent strain relief at the point as near as possible to the end of the elastic strain, i.e., it is necessary to quickly analyze the core in order to obtain the maximum amount of strain relief, and to minimize the error in determining the in-situ directions of the principal horizontal strains (stresses) from the relaxation data.

Observing Fracture Direction Through Use Of Circumferential Acoustic Scanning Tool Another useful method for determining fracture orientation is through the use of Halliburton's Circumferential Acoustic Scanning Tool (CAST) which provides a full bore hole image during the fracturing procedure. The use of the CAST for determining the magnitude of the minimum principal horizontal stress is fully set forth in a pending application, which is also assigned to the assignee of this application (application Ser. No. 07/897,325, filed Jun. 11, 1992, now U.S. Pat. No. 5,236,040).

The CAST is the subject of U.S. Pat. No. 5,044,462, which is hereby incorporated by reference. By way of background, the CAST provides full bore hole imaging through use of a rotating ultrasonic transducer. The transducer, which is in full contact with the bore hole fluid, emits high-frequency pulses which are reflected from the bore hole wall. The projected pulses are sensed by the transducer, and a logging system measures and records reflected pulse amplitude and two-way travel time. The CAST provides a very thorough acoustic analysis of the well bore as typically some 200 shots are recorded in each 360° of rotational sweep, and each rotational sweep images about 0.3" in the vertical direction; however, these parameters may be varied as the CAST has variable rotational speed and a selectable circumferential sampling rate, as well as variable vertical logging speeds.

The images produced by the CAST yield very useful information, not only about fracture direction, but also about stress magnitude, formation homogeneity, bedding planes, as well as other geological features. The amplitude and travel time logs are typically presented as raster scan images. The raster scan televiewer images produce grey level images which can be processed to produce a variety of linear color scales to reflect amplitude and/or travel time variations.

However, it must be remembered that sonic energy, not light, is responsible for the illumination of the details of the interior of the bore hole. The amount of illumination, otherwise known as gray shading, of a particular point of the amplitude image is determined by the amount of returning sonic energy; white indicates the highest amount of returned energy while black represents that very little, or essentially no sonic energy has returned from a particular shot.

Likewise, in the case of travel time, white shading represents a fast travel time, while black represents a very long travel time, or no return. Since travel time is normally dependent on the distance of the two-way traverse, it can be surmised that the objects which are light gray or white are relatively close to the transducer, and objects which are dark gray or black are relatively far away.

In general, fine grain, competent rocks, such as massive carbonates and tight sandstones, make good sonic reflectors. This means that televiewer images of these types of rocks would be white or light gray in amplitude, and probably travel time as well. On the other hand, shales and friable sandstones usually exhibit a rough, irregular reflective surface. Therefore, the images of such rocks are most likely to black or dark gray.

The CAST is very useful in fracture reconnaissance. Because the CAST is recording a 360° gap-free image, as opposed to simple log curves, spatial consideration such as fracture orientation, width, and density may be recognized and mapped. In particular, use of the CAST during an open hole microfrac test allows determination of the direction of fracture propagation.

Figure 11:
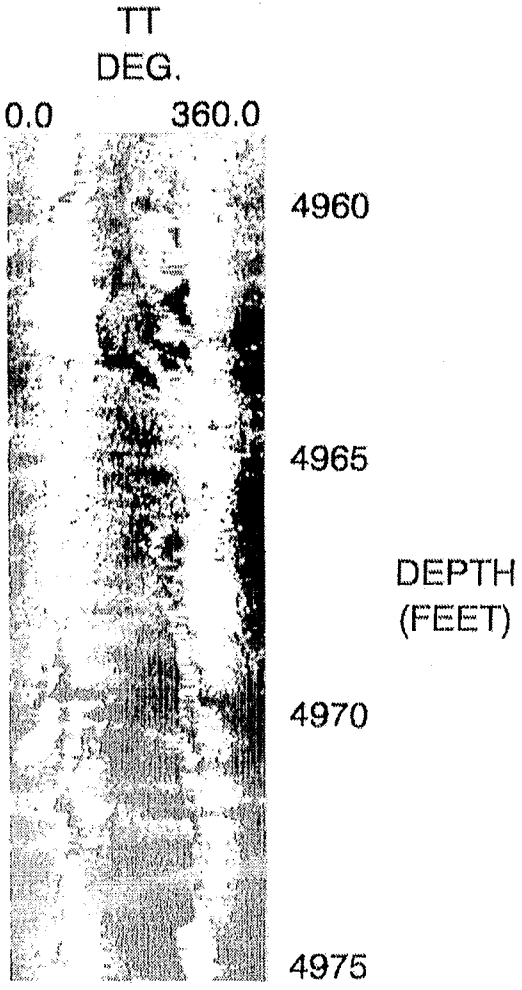
FIG. 11 is another photograph of a representation of an open fracture in a well bore as shown on the travel time raster scan image produced by use of a circumferential acoustic scanning tool.
Figure 10:
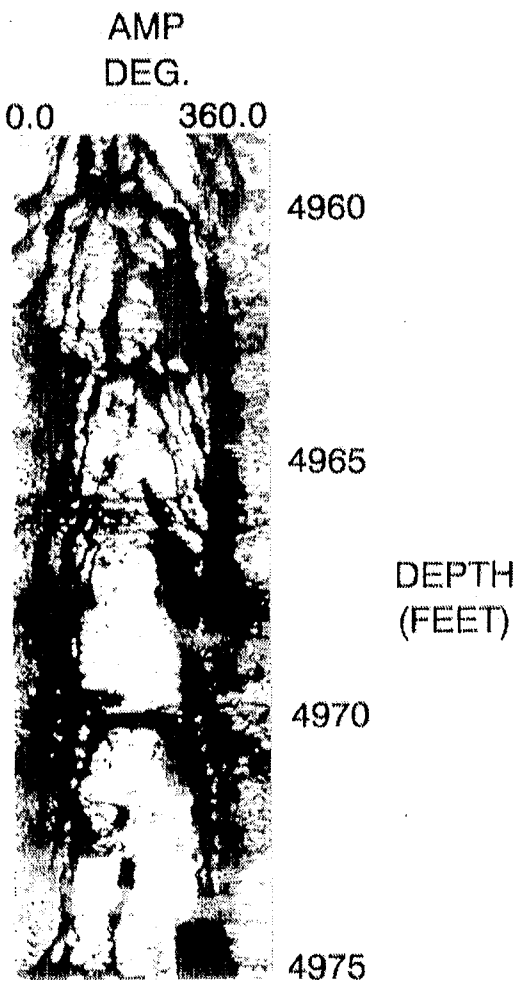
FIG. 10 is a photograph of a representation of an open fracture in a well bore as shown on the amplitude raster scan image produced by use of a circumferential acoustic scanning tool.
Figure 12:
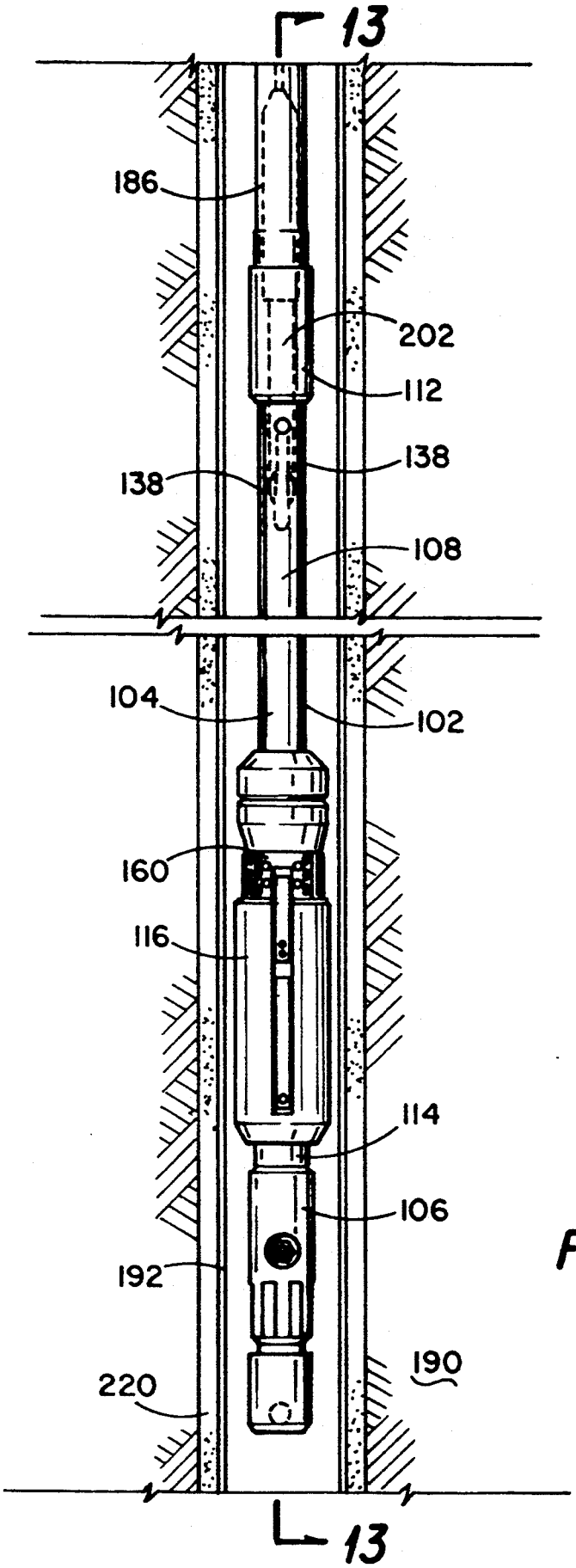
FIG. 12 provides an elevational schematic view of a tool string 102 used in the method of the present invention.
Figure 13A:
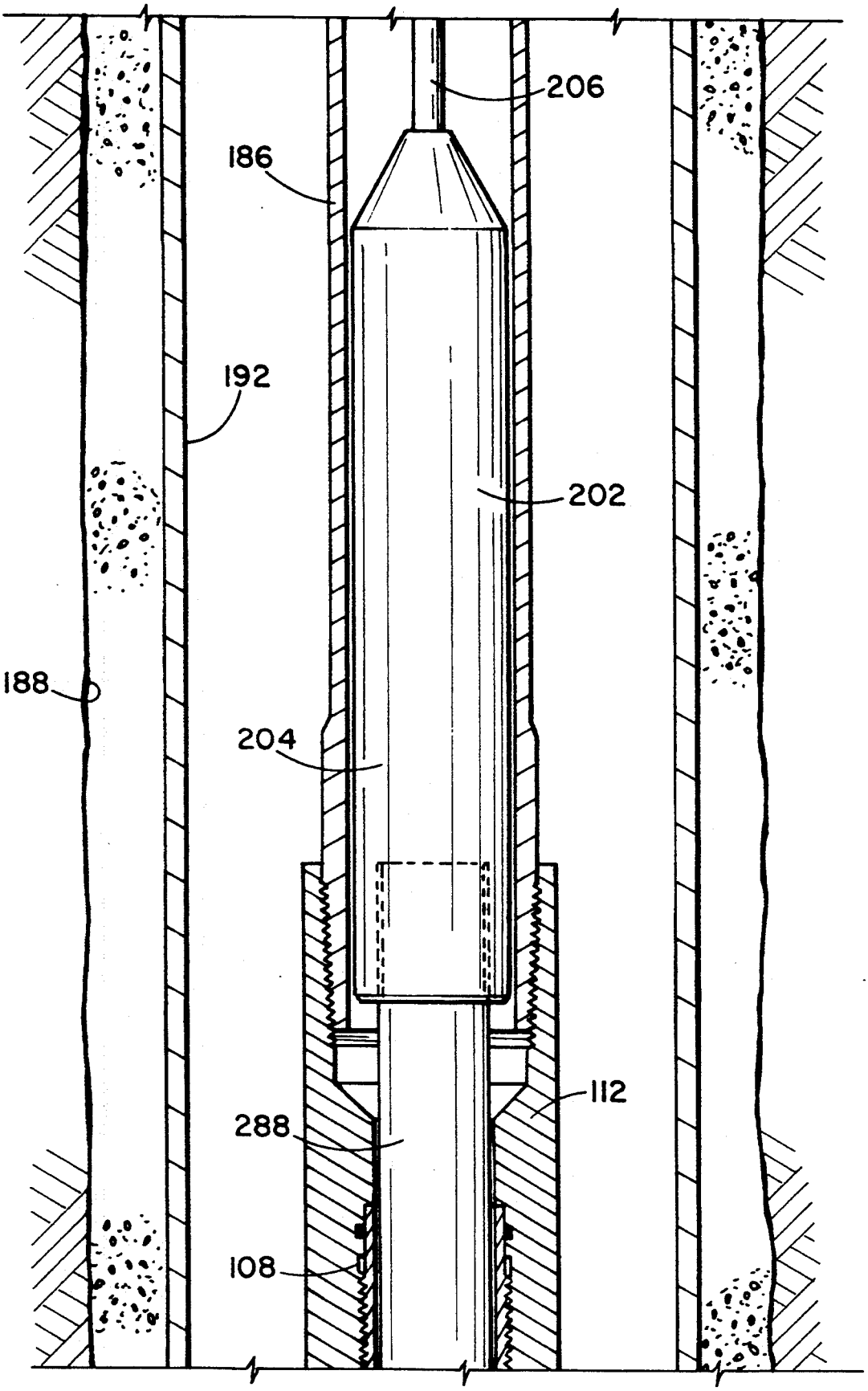
FIGS. 13A through 13E provide a partially cutaway elevational view of tool string 102.
Figure 13B:
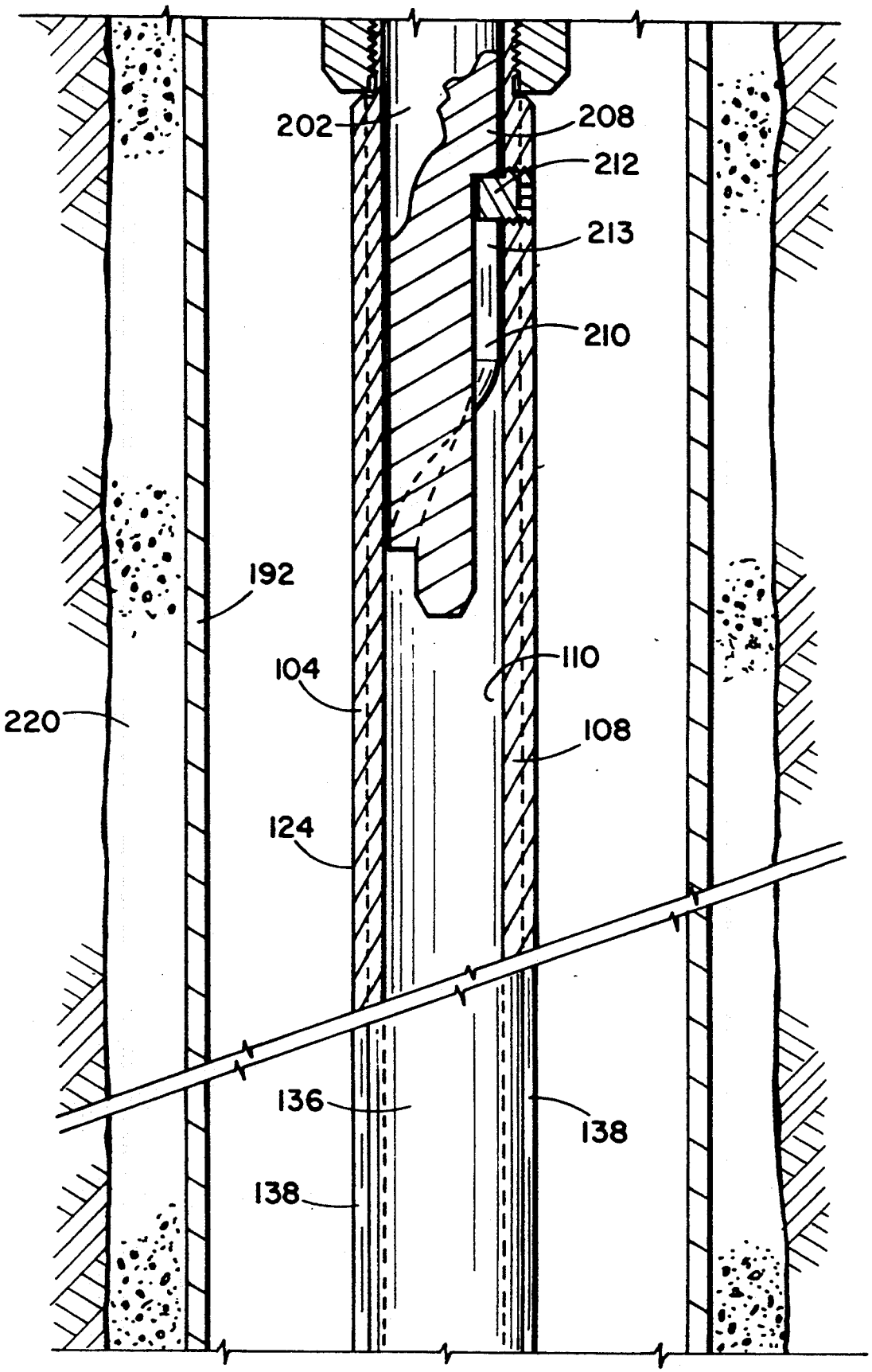
Figure 13C:
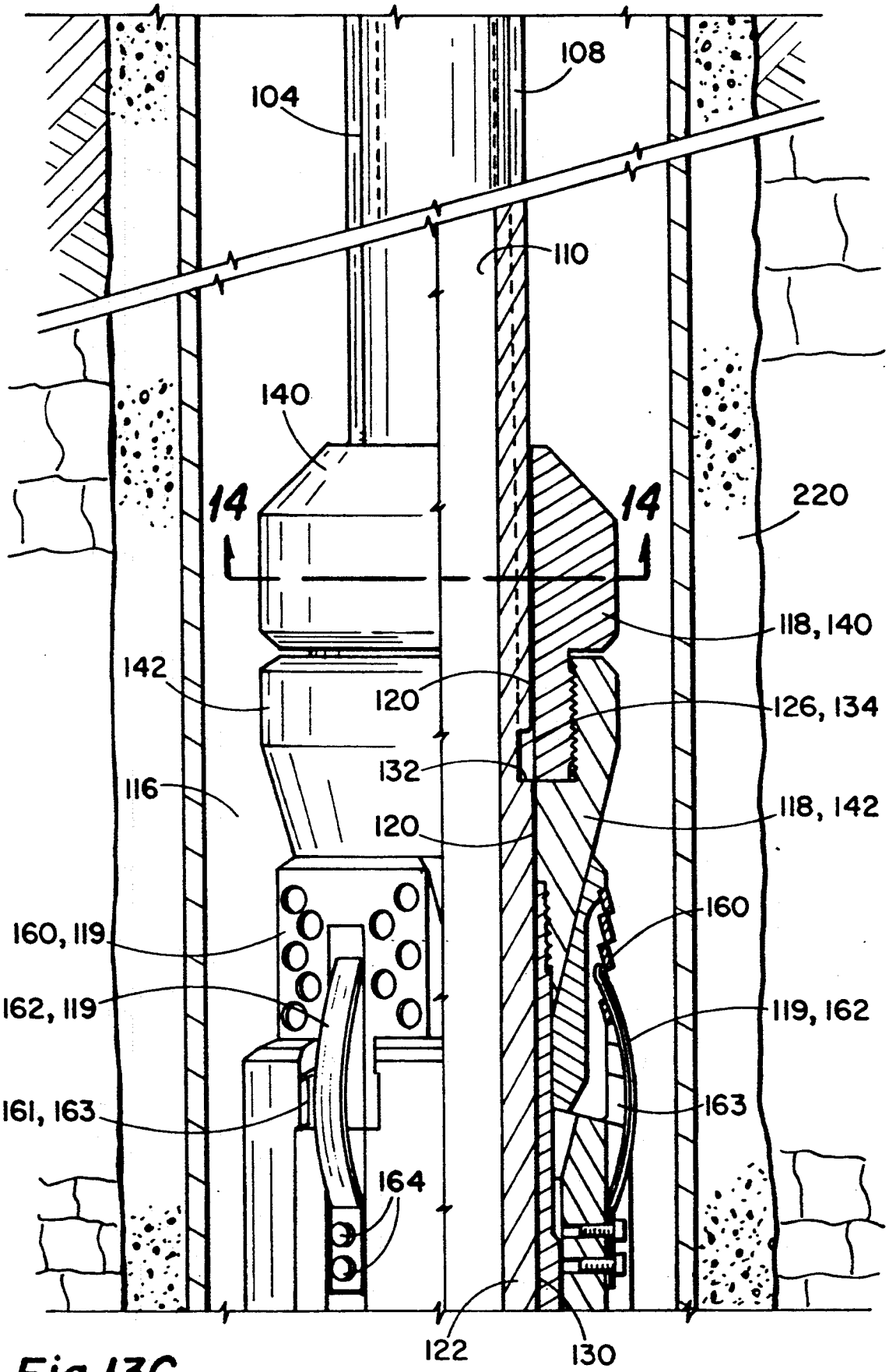
Figure 13D:
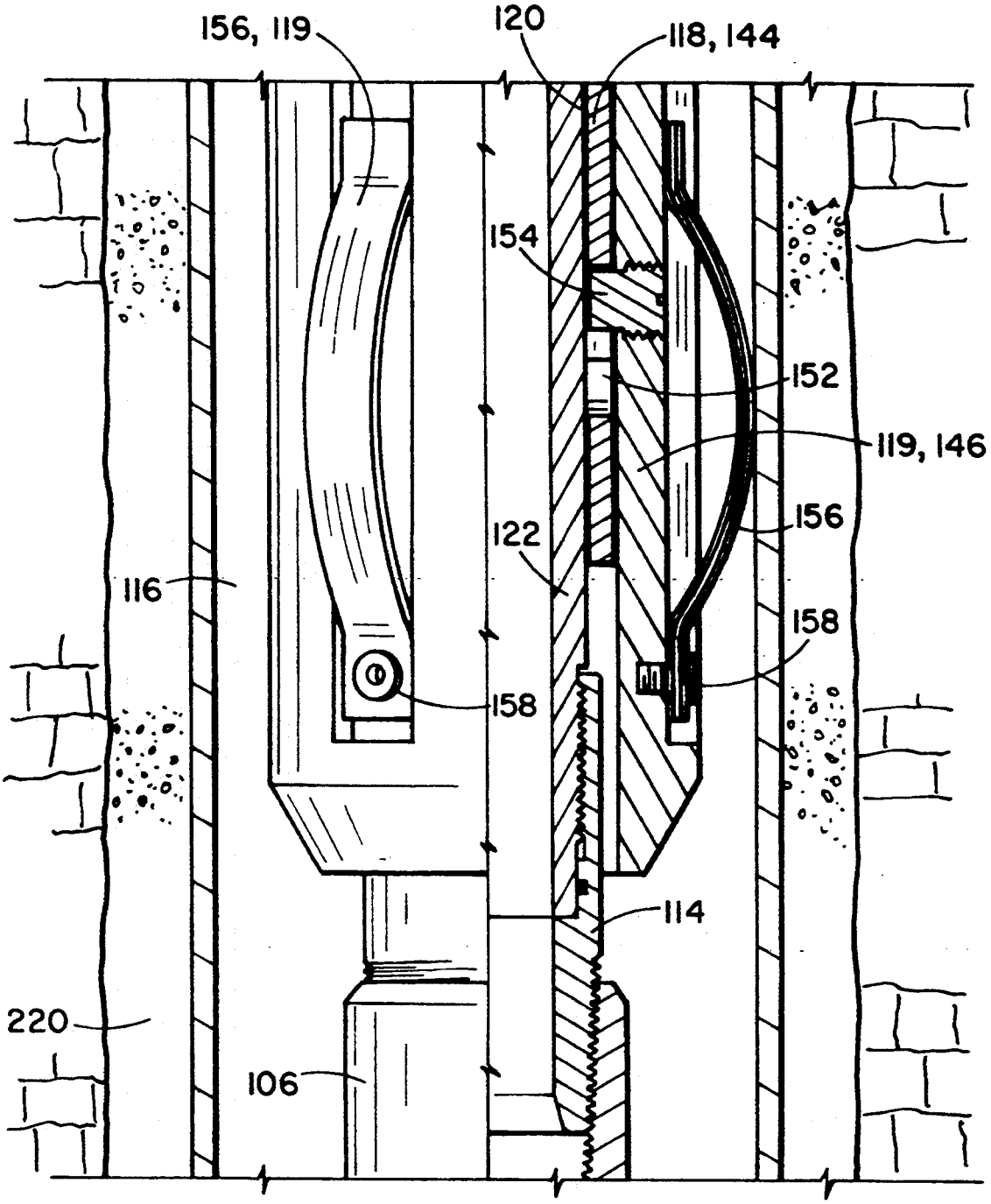
Figure 13E:
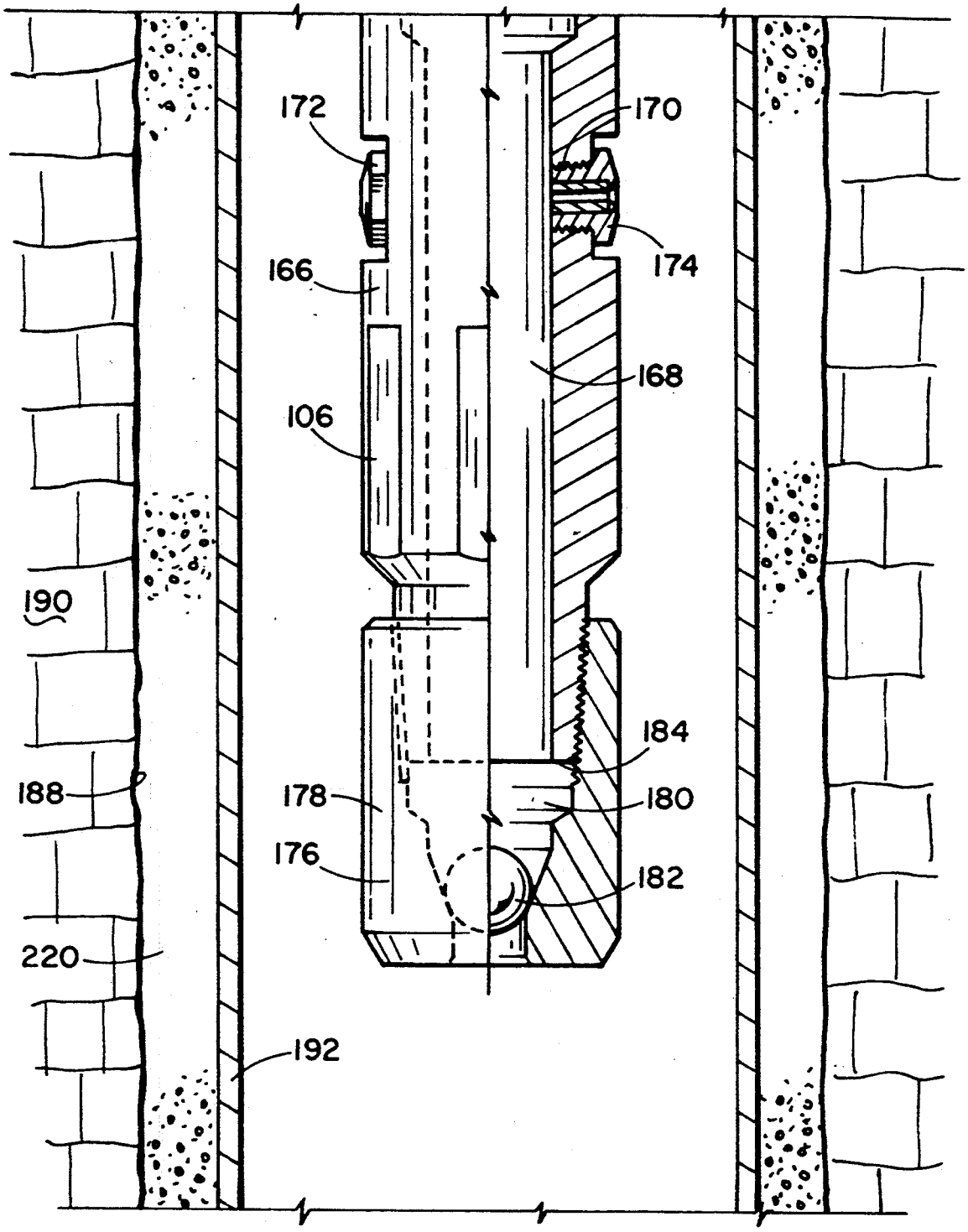

In order to determine fracture orientation with use of the CAST, it is necessary to distinguish open fractures from closed fractures. First, a fracture pattern must be recognized in the amplitude image as shown in FIG. 10. Next, the analyst must look for the corresponding pattern expression in the travel time track. If no corresponding pattern exists, it can be assumed that no cavity exists where the fracture intersects the bore hole; therefore, the fracture is closed. If a black shading does exist in the corresponding pattern of the travel time track as shown in FIG. 11, then the CAST has detected a cavity at the intersection of the fracture and the bore hole; therefore, the fracture is assumed to be open.

Normally, the data obtained through use of the CAST is presented as two dimensional (horizontal and vertical) raster scan images of the "unwrapped" bore hole. The horizontal axis of the CAST images provides information as to the orientation of the induced fractures, i.e., the CAST images are presented as if the bore hole had been cut along the northerly direction and unwrapped.

The CAST may also be oriented through use of any of a variety of known gyroscopic or magnetic means that may be attached to the tool or to an orientation sub.

One such suitable device is the Omni DG76® four-gimbal gyro platform available from Humphrey, Inc., 9212 Balboa Ave., San Diego, Calif. 92123, (619) 565-6631. Similar gyroscopic/accelerator technologies may be substituted for the orientation means which include other mechanical rate gyros, ring laser-type gyros, or fiber optics-type gyros.

Use of the CAST in conjunction with the open hole microfrac test will allow determination of fracture orientation. The wireline retrievable CAST may be lowered into the well bore during the microfrac test. Thereafter, the pressure of the fracturing fluid is gradually increased until fractures are induced in the formation. The fracture may be directly observed from the images produced by the CAST as they are initiated in the formation. In particular, as set forth above, the opening of the fractures is first observed in the amplitude image, and then confirmed in the travel time track. Thus, by noting the orientation of the fractures shown on the images produced by the CAST, the direction of the fracture propagation may be determined.

The Inventive Slotting Method

In the inventive method, typically, any of the aforementioned techniques for determining the direction of fracture propagation may be performed at various levels within a well bore, e.g., above and below the region of the formation of particular interest. After determining the direction of fracture propagation, drilling operations may be continued and, if desired, a casing may be installed in the well. Thereafter, a slotting device is placed in the well bore and is aligned and oriented such that the slots formed by the slotting device are aligned with the previously determined direction of fracture propagation, thereby eliminating the near well bore tortuosity phenomenon discussed above.

Although this invention has been discussed in the context of several representative methods for determining the existing state of stress and the direction of fracture propagation within a field, the invention should not be considered limited to the representative methods discussed herein. Rather, the invention should be construed to cover all methods of determining the direction of fracture propagating within a given field.

A tool string 102 preferred for use in the inventive slotting method is depicted in FIGS. 12–15. Tool string 102 includes a slotting assembly 104 and a jetting tool 106 which is positioned below slotting assembly 104. Slotting assembly 104 includes: an elongate mandrel 108 having a passageway 110 extending longitudinally therethrough; an upper adapter 112 which is threadedly connected to the upper end of mandrel 108; a lower adapter 114 which is threadedly connected to the lower end of mandrel 108; and a slip assembly 116 which surrounds mandrel 108. Slip assembly 116 effectively provides (1) a housing 118 having a passageway 120 extending longitudinally therethrough and (2) a holding means 119 which can be selectively operated for holding the housing in fixed position in a well bore. Elongate mandrel 108 is slidably received in passageway 120 of slip assembly housing 118.

Elongate mandrel 108 includes a lower elongate cylindrical portion 122, an upper elongate portion 124, and a short middle cylindrical portion 126 extending between lower portion 122 and upper portion 124. A radial shoulder 132 is defined by the transition from lower portion 122 to middle portion 126. Lower cylindrical portion 122 has a cylindrical exterior surface 130. Mid-cylindrical portion 126 has a cylindrical exterior surface 134 having a smaller diameter than cylindrical surface 130. The exterior of upper elongate portion 124 comprises a plurality of semi-cylindrical portions 136 and a plurality of semi-cylindrical portions 138. The exterior diameter of upper elongate portion 124 as defined by opposing semi-cylindrical portions 136 is substantially equal to the exterior diameter of middle cylindrical portion 126. However, the exterior diameter of upper elongate portion 124 as defined by opposing semi-cylindrical portions 138 is substantially equal to the exterior diameter of lower cylindrical portion 122. Opposing cylindrical portions 138 of upper man&el portion 124 effectively provide elongate rails which allow mandrel 108 to be moved longitudinally within the slip assembly housing but prevent mandrel 108 from rotating within the slip assembly housing.

Slip assembly housing 118 comprises: an upper sliding body 140; a wedge body 142 which is threadedly connected to sliding body 140; a J-slot sleeve 144 which is threadedly connected to wedge body 142; and a slip body 146 which covers J-slot sleeve 144. The interior diameter of the portion of slip assembly housing 118 defined by wedge body 142 and J-slot sleeve 144 corresponds to the external diameter of lower cylindrical portion 122 of mandrel 108. Consequently, lower mandrel portion 122, mid-mandrel portion 126, and upper mandrel portion 124 are each slidably receivable in wedge body 142 and J-slot sleeve 144.

Figure 14:
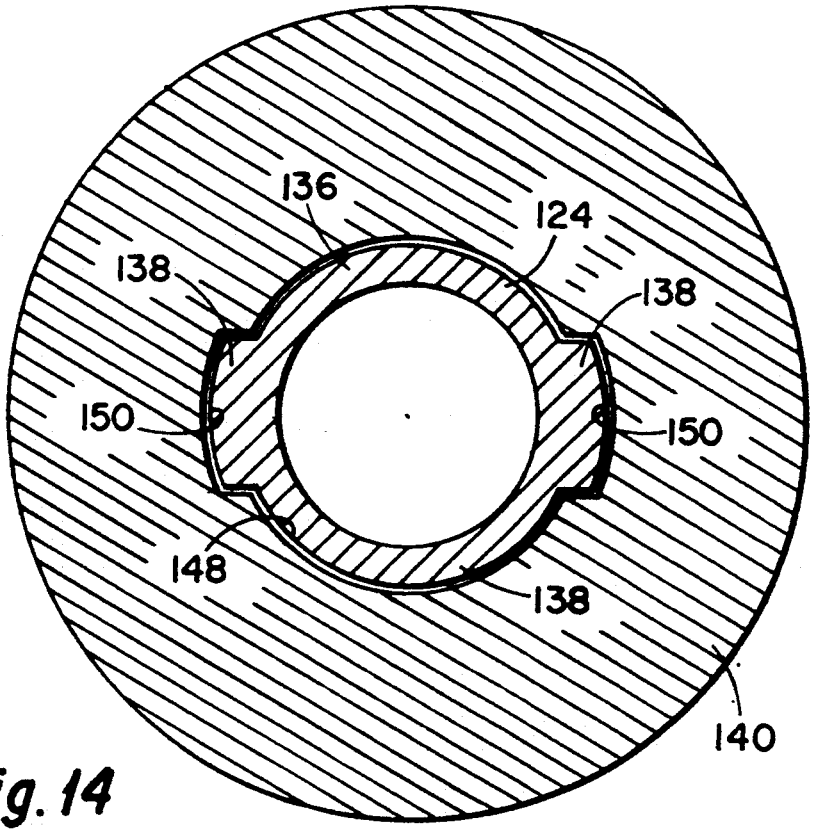
FIG. 14 provides a cross-sectional view of a slotting assembly 104 used in the inventive method.

The interior of sliding body 140 substantially corresponds to the exterior shape of upper mandrel portion 124. As depicted in FIG. 14, the interior of upper sliding body 140 basically includes (a) a cylindrical bore 148 having a diameter slightly larger than the diameter defined by semi-cylindrical portions 136 of upper mandrel portion 124 and (b) grooves 150 sized for slidably receiving opposing rails 138 of upper mandrel portion 124. Since the diameter of bore 148 is slightly larger than the exterior diameter defined by semi-cylindrical portions 136 of upper mandrel portions 124, both upper mandrel portion 124 and middle mandrel portion 126 can be slidably received in upper sliding body 140. However, since the exterior diameter of lower mandrel portion 122 is larger than the diameter of bore 140, lower mandrel portion 122 cannot be received in sliding body 140. Consequently, the upward sliding movement of mandrel 108 within slip assembly housing 118 will be limited by the abutment of radial shoulder 132 with the lower end of sliding body 140.

Figure 15:
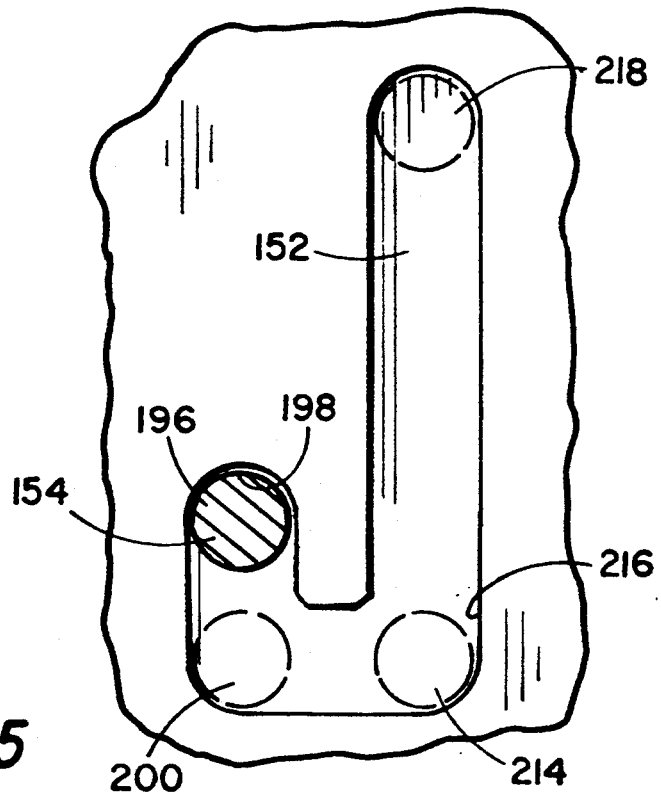
FIG. 15 depicts a J-slot used in slotting assembly 104.
Figure 16:
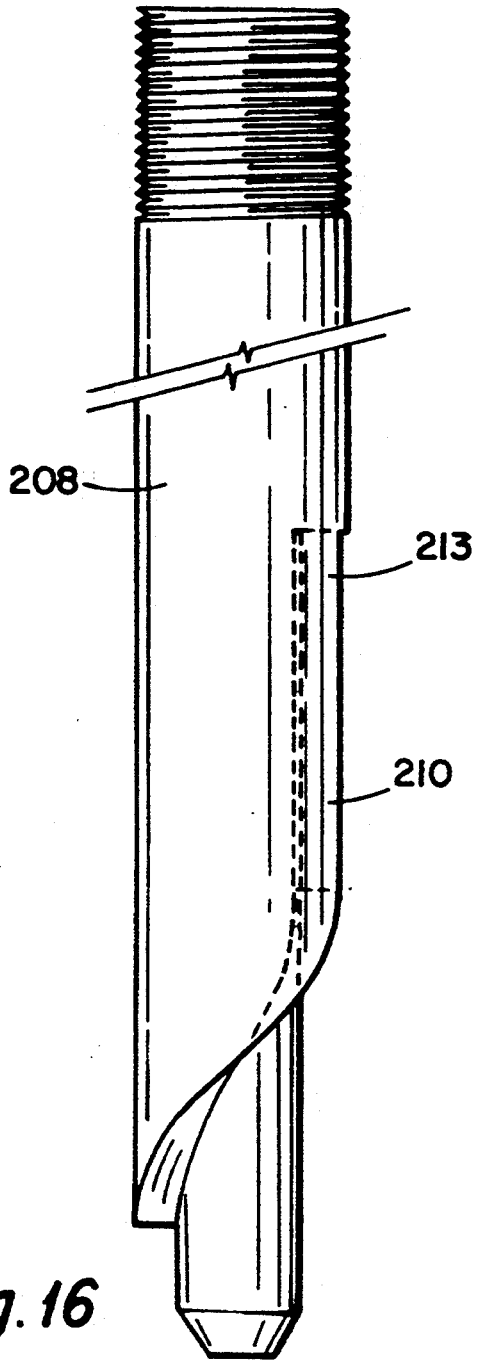
FIG. 16 provides an elevational side view of an orienting sub 108 used in the inventive method.
Figure 17:
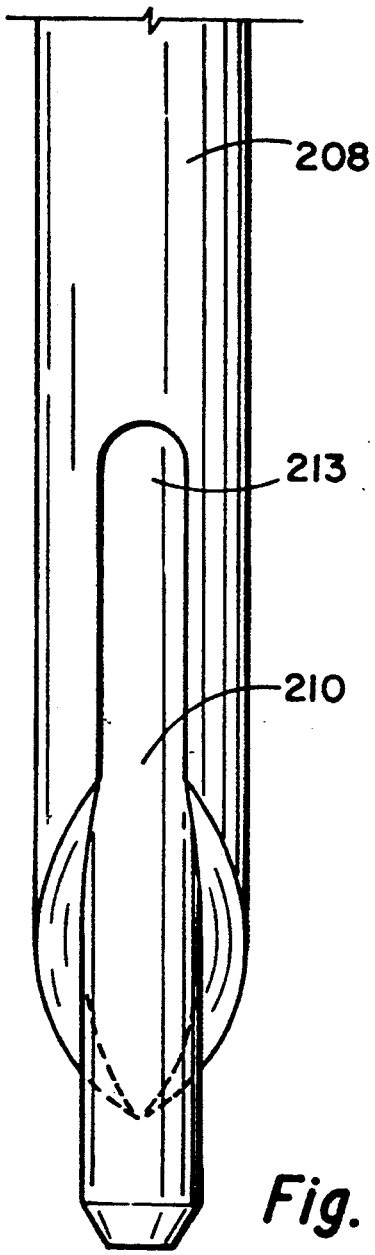
FIG. 17 provides a second elevational side view of orienting sub 108.
Figure 18:
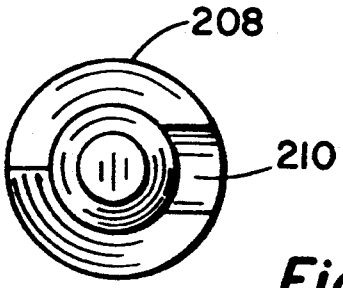
FIG. 18 provides a bottom view of orienting sub 108.

Slip assembly 118 is operated by means of a J-slot 152 provided in J-slot sleeve 144. J-slot 152 is depicted in FIG. 15. Slip body 146 is operably associated with J-slot sleeve 144 by means of a lug 154 having a first portion threadably received in slip body 146 and a second portion which extends into J-slot 152.

The holding means 119 of slip assembly 116 comprises: a plurality of (preferably three) drag springs 156 connected to the exterior of slip body 146 by means of retaining bolts 158; a plurality of (preferably three) slips 160 positioned between wedge body 142 and slip body 146 and having lower crosspieces 161 slidably received in correspondingly shaped slots 163 provided in the upper end of slip body 146; and a plurality of (preferably three) slip retaining springs 162. Each slip retaining spring has a first end which is connected to slip body 146 by means of screws 164 and a second end which rests against a slip 160.

Jetting tool 106 comprises: a body 166 having a passageway 168 extending longitudinally therethrough and having two threaded ports 170 extending through the wall of body 166; jetting nozzles 172 and 174 which are threadedly received in ports 170; and a back pressure valve 176 which is threadedly connected to the lower end of body 166. Ports 170 and jetting nozzles 172 and 174 are preferably positioned in body 166 such that the radial directional orientation of nozzle 172 (i.e., the radial direction in which nozzle 172 will operate with respect to the longitudinal axis of body 166) is 180° from the radial directional orientation of jetting nozzle 174. The upper end of body 166 is threadedly connected to lower adapter 114.

Back pressure valve 176 comprises: a valve body 178 having a passageway 180 extending therethrough; a valve ball 182 positioned in passageway 180; and a ball retaining member 184 positioned in passageway 180. The lower portion of valve body passageway 180 is smaller than valve ball 182 and has a shape corresponding to that of valve ball 182 so that, when fluid is pumped into the upper end of jetting tool body 166, valve ball 182 seals against the small diameter portion of valve body passageway 180 whereby the fluid being pumped into jetting tool 106 is directed through nozzles 172 and 174. Ball retaining member 184, on the other hand, operates to retain valve ball 182 in valve body passageway 180 when back flow is occurring through valve 176 and jetting tool 106. Such back flow will typically occur, for example, as tool string 102 is being lowered into the well bore. The back flow ability of valve 176 also allows recirculating operations to be conducted through tool string 102 in order to remove cuttings and other debris from the well bore.

In the inventive method, a tubing string 186 having tool string 102 included in the distal end thereof is inserted into a well bore 188 such that jetting tool 106 is positioned at a desired fracturing location within a subterranean formation 190. The portion of well bore 188 which is to be slotted can be either a cased well bore segment or an open (i.e., uncased) well bore segment. If the portion of well bore 188 being slotted is an uncased well bore segment, a sufficient amount of tubing is preferably included in tubing string 186 between slotting assembly 104 and jetting tool 106 such that slip assembly 116 can be set, in accordance with the procedure described hereinbelow, in an upper cased portion of well bore 188.

When lowering tool string 102 into a casing 192, mandrel 108 slides downward through slip assembly 116 such that upper adapter 112 contacts and pushes against upper sliding body 140. At the same time, lug 154 is located in J-slot 152 at position 196 such that J-slot surface 198 contacts and pushes lug 154. The force exerted by adapter 112 against sliding body 140 and the force exerted by J-slot surface 198 against lug 154 operate jointly to (1) overcome the force exerted by drag springs 156 against the casing wall such that slip assembly 116 is pushed downhole while (2) preventing wedge body 142 from sliding beneath slips 160 and engaging slips 160 against casing 192.

When jetting tool 106 has been lowered to a desired longitudinal position within well bore 188, tubing string 186 is raised such that man&el 108 slides upward through slip assembly 116 and radial shoulder 132 of man&el 108 is placed in abutment with the lower end of upper sliding body 140. Tubing string 186 is then raised slightly further such that lug 154 moves from position 196 in J-slot 152 to position 200. Raising the tool string operates to move lug 154 from position 196 to position 200 since (1) the operation of drag springs 156 against casing 192 operates to hold slip body 146 and lug 154 in fixed position within the well bore while (2) the lifting of tool string 102 carries J-slot sleeve 144 upward relative to lug 154.

Before or after lifting tool string 102 to move lug 154 to position 200, an orienting assembly 202 is delivered down the interior of tubing string 186. Orienting assembly 202 comprises an orienting means 204 connected to the distal end of a multi-conductor logging cable 206. Assembly 202 also comprises an orienting sub 208 which is threadedly connected to orienting means 204.

Orienting means 204 can generally be any device which is capable of indicating azimuthal orientation with respect to magnetic north when placed downhole. Examples of such instruments include gyroscopes, magnetometers, accelerometers, and the like. Orienting means 204 preferably comprises a gyroscope. One device which is particularly well-suited for use in the present invention is the Omni DG76® four-gimbal gyro platform available from Humphrey, Inc., 9212 Balboa Ave., San Diego, Calif. Examples of other types of gyroscopic devices suitable for use in the present invention include other mechanical rate gyros, ring laser-type gyros, and fiber optics-type gyros.

Orienting assembly 202 can be run into the well bore by means of a logging truck or other system which includes instrumentation for receiving and interpreting the directional information transmitted from orienting means 204.

Orienting sub 208 is preferably a solid elongate member having a groove 210 formed in the lower exterior portion thereof. Orienting sub 208 is preferably sized such that the lower portion thereof, including groove 210, can be received in the upper portion of mandrel 108 of slotting assembly 104. Groove 208 is preferably sized to receive a lug 212 which extends into the upper portion of mandrel passageway 110. Groove 208 is configured such that, as sub 208 is lowered into contact with lug 212, sub 208 automatically rotates such that lug 212 is channeled into the upper portion 2 13 of groove 210.

When assembling tool string 102, jetting tool 106 is connected to slotting assembly mandrel 108 such that the positions of jetting nozzles 172 and 174 with respect to lug 212 are known. Additionally, orienting assembly 202 is assembled such that the orientation of upper groove portion 213 with respect to orienting sub 208 is known. Consequently, when orienting assembly 202 is delivered downhole such that lug 212 is received in groove portion 213, the directional orientations of jetting nozzles 172 and 174 can readily be determined.

With lug 154 located in J-slot position 200 and lug 2 12 received in orienting sub groove 213, tubing string 186, including mandrel 108 and J-slot sleeve 144, is rotated such that lug 154 moves from J-slot position 200 to J-slot position 214. Until J-slot sleeve 144 has rotated sufficiently to place lug 154 in position 214, drag springs 156 prevent slip body 146 and lug 154 from rotating in the well bore.

With lug 154 held in position 214 by J-slot surface 216, tool string 102 is further rotated until the directional orientation of jetting nozzles 172 and 174 corresponds with the predetermined direction of fracture propagation existing in formation 190. During this portion of the rotating operation, J-slot surface 2 16 pushes against lug 154 such that the entire slotting assembly 104, including slip body 146, rotates within casing 192.

In order to hold nozzles 172 and 174 in properly oriented position during the slotting operation, tubing string 186 is lowered such that mandrel 108 slides downward through slip assembly 116 and upper adapter 112 contacts upper sliding body 140. Tubing string 186 is then further lowered such that upper adapter 112 pushes sliding body 140, wedge body 142, and J-slot sleeve 144 downward and lug 154 moves from position 214 in J-slot 152 toward position 218. As this lowering step is occurring, drag springs 156 hold slip body 146 in fixed position in casing 192 so that wedge body 142 slides beneath slips 160. Slips 160 are thereby urged tightly against the interior wall of casing 192. With slips 160 thus positioned against casing 192, slip assembly 116 is substantially prevented from moving either longitudinally or rotationally within casing 192.

After properly orienting nozzles 172 and 174, orienting assembly 202 is preferably removed from tubing string 186.

With jetting nozzles 172 and 174 thus oriented in casing 192, jetting nozzles 172 and 174 are preferably used to cut slots through casing 192, through any cement sheath 220 surrounding casing 160, and into formation 190. This cutting procedure is accomplished by (1) pumping a hydraulic jetting fluid down tubing string 186 and through jetting nozzles 172 and 174 while (2) raising tubing string 186 within casing 192. As tubing string 186 is raised, slotting assembly mandrel 108 slides upward through slip assembly housing 118. This upward movement of mandrel 108 carries jetting tool 106 upward at the same speed and over the same distance.

It is also noted that, if desired, mandrel 108 can be transferred upward through slip assembly 116 prior to the slot cutting operation so that, during the slot cutting operation, mandrel 108 and jetting tool 116 are lowered while hydraulic jetting fluid is pumped through jetting nozzles 172 and 174.

The rate of ascent or descent of tubing string 186 and jetting tool 106 during the cutting operation is controlled at the well head. As will be understood by those skilled in the art, an above-ground, remotely controlled, hydraulic ram can be used in order to ensure that a very smooth and well regulated rate of ascent or descent is obtained. As will also be understood by those skilled in the art, the rate of ascent or descent of jetting tool 106 could alternatively be controlled downhole by including a metering assembly in slotting assembly 104.

With slip assembly 116 held in fixed position in casing 192 and with mandrel rails 138 retained in grooves 150 of upper sliding body 140 of slip assembly 116, elongate mandrel 108 and jetting nozzle 106 are prevented from rotating within casing 192 during the slot cutting operation. Consequently, the entire length of each slot will be aligned with the predetermined direction of fracture propagation within formation 190.

The hydraulic jetting fluid used in the inventive method can generally be any jetting fluid which is commonly used to cut slots in well casings and/or well bores. Examples include water, gels, foams, oil, diesel, kerosene, and combinations thereof. The jetting fluid will also preferably include an abrasive particulate material (e.g., sand). The particle size of the abrasive material must be small enough to allow the material to readily pass through jetting nozzles 172 and 174. The abrasive material will typically be present in the jetting fluid in an amount in the range of from about 0.25 pound to about 1 pound of abrasive material per gallon of fluid.

After the cutting operation is completed, slip assembly 116 can be released by simply lifting tubing string 186. As tubing string 186 is lifted, mandrel radial shoulder 132 abuts and pushes against the lower end of upper sliding body 140. As the tubing string continues to move upward, radial shoulder 132 carries sliding body 140, wedge body 142, and J-slot sleeve 144 upward such that slips 160 are allowed to retract inward away from casing 192 and lug 154 moves to position 214 in J-slot 152.

If more than one pair of opposing slots is to be cut in casing 192 and/or formation 190, the lowermost pair of slots will preferably be cut first. After releasing slip assembly 116, tubing string 186 will then be raised until jetting tool 106 is located at the longitudinal position where the next highest pair of slots is to be cut. As the tubing string is raised, lug 154 will be located at position 214 in J-slot 152 so that, unless the tubing string is rotated during the lifting operation, the nozzle orientation established in the preceding cutting operation should be maintained. However, in order to ensure that the proper nozzle orientation is maintained, it is preferred that orienting assembly 202 again be delivered downhole and that the orienting procedure be repeated.

It will be understood that much of the benefit provided by the present invention will be obtained as long as the slots formed in accordance with the inventive method are oriented within about $\pm 15°$ (preferably within $\pm 10°$) of the vertical plane extending through the longitudinal axis of jetting tool 106 which is perpendicular to the true minimum principal stress existing within the formation. Such deviation from the optimum slot orientation can occur due to inaccuracies inherent in the devices and methods employed to determine the direction of fracture propagation and in the devices used for orienting jetting tool 106.

In addition to the above, it is noted that it is not necessary that the direction of fracture propagation be determined at each and every well within a field or region. Rather, after employing the methods and techniques disclosed and claimed herein to determine the direction of fracture propagation at a sufficient number of strategically located wells within a field or region (e.g. wells at the field boundaries), if the results obtained thereby are in substantial agreement, the stress pattern existing in the formation throughout a particular geographic region (or maybe for the entire region) may be determined. The number of wells that must be tested in order to determine the region-wide stress pattern will depend upon a multitude of factors; however, the direction of fracture propagation will preferably be determined at at least three wells that are strategically positioned or bounded around the region in order to have sufficient data from which to infer the direction of stress existing throughout the region. If this technique is employed, then at subsequent wells it would only be necessary to align the slotting device with the previously determined field or region wide direction of fracture propagation and fracture the well. Through this technique, the additional time and expense of determining fracture orientation at each and every well can be avoided.

Additionally, in certain situations, it may be desirable to slot a given well in the direction of natural fractures existing within the formation. Of course, these fractures may or may not be aligned with the present stresses within the formation. Nevertheless, by slotting in the direction of such fractures, production of hydrocarbons may be increased. In particular, through the use of the Computed Tomography ("CT") technique or the oriented CAST tool to determine fracture direction, both of which are disclosed herein, with or without an open hole microfrac test, it is possible to determine the direction of natural fracture orientation. Therefore, aligning slots with the previously determined direction of natural fractures within a formation is also within the scope of the present invention.

Through the use of the techniques disclosed herein, the direction of fracture propagation, or natural fractures, within a given formation may be determined. Thereafter, a slotting device may be oriented such that the slots produced by the device are aligned with the previously determined direction. Fracturing operations are then performed to complete the well. Of course, the present methods may be employed in both vertical and deviated wells; e.g. horizontal or wells drilled at an angle relative to a vertical well. When using the inventive method in horizontal or other highly deviated wells, coiled tubing can be used to deliver orienting assembly 202 downhole. Additionally, in horizontal and other highly deviated wells, back pressure valve 176 will preferably be replaced with a spring loaded ball valve or a poppet valve.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A method for fracturing a subterranean formation having a well bore extending thereinto, said method comprising the steps of:

(a) placing a jetting tool in said well bore such that said jetting tool is positioned within said subterranean formation, said jetting tool including a first jetting nozzle;

(b) orienting, by rotating said jetting tool about a longitudinal axis, said jetting tool such that the directional orientation of said first jetting nozzle substantially corresponds to a selected fracturing direction;

(c) cutting a slot in said subterranean formation by substantially maintaining the first jetting nozzle orientation established in step (b) while both (i) spraying a jetting fluid out of said first jetting nozzle and (ii) moving said jetting tool longitudinally within said well bore along said longitudinal axis.

2. The method of claim 1 wherein said selected fracturing direction is a direction within about ±10°, based on the rotation of said jetting tool about said longitudinal axis, of a direction which is perpendicular to the direction of minimum principal stress in said subterranean formation.

3. The method of claim 2 further comprising the step of determining said direction of minimum principal stress.

4. The method of claim 1 wherein said selected fracturing direction is a direction, based on the rotation of said jetting tool about said longitudinal axis, within about ±10° of the direction of a pre-existing fracture in said subterranean formation.

5. The method of claim 1 wherein:

said jetting tool is included in a tubing string;

said tubing string further includes a slotting assembly;

said slotting assembly comprises:

a housing having a housing passageway extending therethrough;

a holding means which can be selectively operated for holding said housing in fixed position in said well bore, an elongate man&el slidably received in said housing passageway, said mandrel having a mandrel passageway extending longitudinally therethrough, and means for preventing said mandrel from rotating within said housing;

said jetting tool is associated with said mandrel such that, whenever said mandrel is moved within said well bore, said jetting tool also moves in a direction and for a distance corresponding to the direction and distance of movement of said mandrel;

said method further comprises the step, following step (b), of operating said holding means such that said housing is held in fixed position in said well bore; and said jetting tool is moved longitudinally within said well bore in accordance with step (c) by sliding said mandrel within said housing passageway.

6. The method of claim 5 wherein:

said method further comprises the step of associating an orienting assembly with said slotting assembly, said orienting assembly including an orientation determining means for determining the directional orientation of said first jetting nozzle;

said jetting tool is oriented in accordance with step (b) by rotating said slotting assembly and said jetting tool in said well bore to a position wherein the directional orientation of said first jetting nozzle as indicated by said orientation determining means substantially corresponds to said selected fracturing direction.

7. The method of claim 6 wherein said orientation determining means comprises a gyroscope.

8. The method of claim 6 wherein:

said orienting assembly further includes a first associating means;

said slotting assembly further includes a second associating means;

one of said associating means is receivable in the other of said associating means for associating said orienting assembly with said slotting assembly; and in said step of associating, said orienting assembly is delivered through said tubing string until said one associating means is received in said other associating means.

9. The method of claim 8 wherein said method further comprises the step, after step (b) and prior to step (c), of removing said orienting assembly from said tubing string.

10. The method of claim 1 wherein:

said jetting tool further includes a second jetting nozzle positioned in said jetting tool such that the radial directional orientation of said second jetting nozzle with respect to said longitudinal axis is substantially 180° from the radial directional orientation of said first jetting nozzle with respect to said longitudinal axis and a second slot is cut in said subterranean formation in step (c) by spraying jetting fluid out of said second jetting nozzle at the same time that jetting fluid is being sprayed out of said first jetting nozzle.

11. A method of fracturing a subterranean formation having a well bore extending thereinto with a casing positioned in said well bore, said method comprising the steps of:

(a) placing a jetting tool in said casing such that said jetting tool is positioned within said subterranean formation, said jetting tool including a first jetting nozzle;

(b) orienting, by rotating said jetting tool about a longitudinal axis, said jetting tool such that the directional orientation of said first jetting nozzle substantially corresponds to a selected fracturing direction; and (c) cutting a slot in said casing by substantially maintaining the first jetting nozzle orientation established in step (b) while both (i) spraying a jetting fluid out of said first jetting nozzle and (ii) moving said jetting tool longitudinally within said casing along said longitudinal axis.

12. The method of claim 11 wherein said selected fracturing direction is a direction within about ±10°, based on the rotation of said jetting tool about said longitudinal axis, of a direction which is perpendicular to the direction of minimum principal stress in said subterranean formation.

13. The method of claim 12 further comprising the step of determining said direction of minimum principal stress.

14. The method of claim 11 wherein said selected fracturing direction is a direction, based on the rotation of said jetting tool about said longitudinal axis, within about ±10° of the direction of a pre-existing fracture in said subterranean formation.

15. The method of claim 11 wherein:

said jetting tool is included in a tubing string;

said tubing string further includes a slotting assembly;

said slotting assembly comprises:

a housing having a housing passageway extending therethrough;

a holding means which can be selectively operated for holding said housing in fixed position in said casing, an elongate mandrel slidably received in said housing passageway, said mandrel having a mandrel passageway extending longitudinally therethrough, and means for preventing said mandrel from rotating within said housing;

said jetting tool is associated with said mandrel such that, whenever said mandrel is moved within said casing, said jetting tool also moves in a direction and for a distance corresponding to the direction and distance of movement of said mandrel;

said method further comprises the step, following step (b), of operating said holding means such that said housing is held in fixed position in said casing; and said jetting tool is moved longitudinally within said casing in accordance with step (c) by sliding said mandrel within said housing passageway.

16. The method of claim 15 wherein:

said method further comprises the step of associating an orienting assembly with said slotting assembly, said orienting assembly including an orientation determining means for determining the directional orientation of said first jetting nozzle;

said jetting tool is oriented in accordance with step (b) by rotating said slotting assembly and said jetting tool in said casing to a position wherein the directional orientation of said first jetting nozzle as indicated by said orientation determining means substantially corresponds to said selected fracturing direction.

17. The method of claim 16 wherein said orientation determining means comprises a gyroscope.

18. The method of claim 16 wherein:

said orienting assembly further includes a first associating means;

said slotting assembly further includes a second associating means;

one of said associating means is receivable in the other of said associating means for associating said orienting assembly with said slotting assembly; and in said step of associating, said orienting assembly is delivered through said tubing string until said one associating means is received in said other associating means.

19. The method of claim 18 wherein said method further comprises the step, after step (b) and prior to step (c), of removing said orienting assembly from said tubing string.

20. The method of claim 11 wherein:

said jetting tool further includes a second jetting nozzle positioned in said jetting tool such that the radial directional orientation of said second jetting nozzle with respect to said longitudinal axis is substantially 180° from the radial directional orientation of said first jetting nozzle with respect to said longitudinal axis and a second slot is cut in said casing in step (c) by spraying jetting fluid out of said second jetting nozzle at the same time that jetting fluid is being sprayed out of said first jetting nozzle.

* * * * *

UNITED STATES PATENT AND TRADEMARK OFFICE

CERTIFICATE OF CORRECTION

PATENT NO. : 5,335,724

DATED : August 9, 1994

INVENTOR(S) : James J. Venditto and Kenneth D. Caskey

It is certified that error appears in the above-identified patent and that said Letters Patent is hereby corrected as shown below:

Col. 8, line 21, change "CTN(CT number)=1000X($(\mu/\rho)\rho/(\rho/\rho)_w\rho_w$-1)" to —CTN(CT number)=1000X($(\mu/\rho)\rho/(\mu/\rho)_w\rho_w$-1)—

Col. 18, line 38, change "ting" to --ring--.

Col. 23, lines 64 and 66, change "man&el" to --mandrel--.

IN THE CLAIMS:

Col. 28, claim 5, line 9, change "man&el" to --mandrel--.

Signed and Sealed this

Eighteenth Day of October, 1994

*Attest:*

*Attesting Officer*

BRUCE LEHMAN

*Commissioner of Patents and Trademarks*